US011289806B1

(12) United States Patent
Wyse et al.

(10) Patent No.: US 11,289,806 B1
(45) Date of Patent: Mar. 29, 2022

(54) SYSTEMS AND METHODS FOR WAVELENGTH SCALED OPTIMAL ELEMENTAL POWER ALLOCATION

(71) Applicant: Rockwell Collins, Inc., Cedar Rapids, IA (US)

(72) Inventors: Russell D. Wyse, Center Point, IA (US); Michael L. Hageman, Mount Vernon, IA (US); James B. West, Cedar Rapids, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 262 days.

(21) Appl. No.: 16/189,709

(22) Filed: Nov. 13, 2018

(51) Int. Cl.

| | |
|---|---|
| ***H01Q 3/00*** | (2006.01) |
| ***H01Q 3/26*** | (2006.01) |
| ***H01Q 3/28*** | (2006.01) |
| *H01Q 21/22* | (2006.01) |
| *H01Q 1/50* | (2006.01) |
| *H01Q 21/00* | (2006.01) |

(52) U.S. Cl.
CPC ..... *H01Q 3/26* (2013.01); *H01Q 3/2658* (2013.01); *H01Q 3/28* (2013.01); *H01Q 1/50* (2013.01); *H01Q 21/0006* (2013.01); *H01Q 21/22* (2013.01)

(58) Field of Classification Search
CPC ..... H01Q 3/2658; H01Q 3/26; H01Q 3/28; H01Q 21/22; H01Q 21/0006; H01Q 1/50
USPC ..... 342/371, 372
See application file for complete search history.

(56) References Cited

U.S. PATENT DOCUMENTS

| | | | | |
|---|---|---|---|---|
| 4,257,047 | A * | 3/1981 | Lipsky | G01S 5/04 342/154 |
| 5,959,578 | A * | 9/1999 | Kreutel, Jr. | H01Q 3/26 342/373 |
| 7,034,753 | B1 | 4/2006 | Elsallal et al. | |
| 7,965,242 | B2 * | 6/2011 | Abramov | H01Q 21/28 343/702 |
| 8,334,809 | B2 * | 12/2012 | Nichols | H01Q 3/26 343/700 MS |

(Continued)

OTHER PUBLICATIONS

Balanis, Constantine, Antenna Theory Analysis and Design, 2nd Ed., John Wiley and Sons, 1997, Section 11.4, Log-Period Antennas, pp. 551-566.

(Continued)

*Primary Examiner* — Chuong P Nguyen
(74) *Attorney, Agent, or Firm* — Suiter Swantz pc llo

(57) ABSTRACT

An ESA system includes first antennas, second antennas, a power supply, a transmit module and/or receive module, and a controller. The first antennas operate over a first frequency bandwidth from a first frequency to a second frequency greater than the first frequency. The second antennas operate over a second frequency bandwidth from the first frequency to a third frequency less than the second frequency. The transmit module receives DC power from the power supply and provides RF power corresponding to at least one first control point to the antennas. The controller adjusts the at least one first control point based on a predetermined ratio of a first RF signal strength associated with the first antennas to a second RF signal strength associated with the second antennas, a first passive antenna gain of the first antennas, and a second passive antenna gain of the second antennas.

20 Claims, 14 Drawing Sheets

(56) References Cited

U.S. PATENT DOCUMENTS

| | | | | |
|---|---|---|---|---|
| 8,614,603 | B1 | 12/2013 | Wyse et al. | |
| 8,660,514 | B1 | 2/2014 | Wyse | |
| 8,937,495 | B1 | 1/2015 | Wyse et al. | |
| 8,963,612 | B1 | 2/2015 | Wyse et al. | |
| 9,002,312 | B1 | 4/2015 | Wyse | |
| 9,059,662 | B1 | 6/2015 | Wyse et al. | |
| 9,432,126 | B1 | 8/2016 | Wyse et al. | |
| 9,444,418 | B1 | 9/2016 | Wyse et al. | |
| 9,537,558 | B1 | 1/2017 | Wyse et al. | |
| 9,667,211 | B1 | 5/2017 | Wyse et al. | |
| 9,673,877 | B1 | 6/2017 | Wyse et al. | |
| 9,831,906 | B1 * | 11/2017 | Xie | H03F 3/211 |
| 10,062,966 | B2 * | 8/2018 | Mangenot | H01P 11/00 |
| 10,103,431 | B2 * | 10/2018 | Swirhun | H01Q 3/36 |
| 10,224,629 | B2 * | 3/2019 | West | H01Q 21/0025 |
| 10,224,979 | B1 * | 3/2019 | Hunter | H01Q 15/02 |
| 10,714,840 | B1 * | 7/2020 | West | H01Q 21/0087 |
| 10,811,787 | B1 * | 10/2020 | West | H01Q 1/36 |
| 10,950,939 | B2 * | 3/2021 | West | H01Q 3/2682 |
| 2009/0321620 | A1 * | 12/2009 | Hillis | H01Q 3/2676 250/227.23 |
| 2014/0104107 | A1 * | 4/2014 | Mangenot | H01Q 21/22 342/371 |
| 2017/0054221 | A1 * | 2/2017 | West | H01Q 3/46 |
| 2019/0013592 | A1 * | 1/2019 | West | H01Q 21/0087 |
| 2021/0083399 | A1 * | 3/2021 | Mccordic | H01Q 1/02 |

OTHER PUBLICATIONS

Breakall, J.K., "Introduction to the Three-Dimensional Frequency-Independent Phased-Array (3D-FIPA), A New Class of Phased Array Design", IEEE, 1992. 4 pages.

Cantrell et al., "Wideband Array Antenna Concept", IEEE Aerospace and Electronic Systems Magazine, vol. 21, No. 1, Jan. 2006, pp. 9-12.

Haupt, Randy L., "Antenna Arrays—A Computational Approach", John Wiley & Sons, 2010, pp. 177. 9 pages.

Holland et al., "A Wavelength Scaled Array of Doubly-Mirrored Balanced Antipodal Vivaldi Antennas (DM-BAVAs)", IEEE, 2009. 4 pages.

Kindt et al., "A Wavelength-Scaled Ultra-Wide Bandwidth Array", IEEE Antennas Propagation Symp., Jun. 2009. 4 pages.

Kindt et al., "Analysis of a Wavelength-Scaled Array (WSA) Architecture", IEEE Transactions on Antennas and Propagation, vol. 58, No. 9, Sep. 2010, pp. 2866-2874.

Kindt et al., "Ultrawideband All-Metal Flared-Notch Array Radiator", IEEE Transactions and Antennas and Propagation, vol. 58, No. 11, Nov. 2010. pp. 3568-3575.

Kindt et al., "Wavelength-Scaled Ultra-Wide Bandwidth Multi-Function Phased Arrays", IEEE International Conference on Wireless Information Technology and Systems, 2010. 4 pages.

Kindt, Rick W., "Prototype Design of a Modular Ultrawideband Wavelength-Scaled Array of Flared Notches", IEEE Transactions on Antennas and Propagation, vol. 60, No. 3, Mar. 2012. 9 pages.

Lee et al., "Planar Ultrawideband Modular Antenna (PUMA) Wavelength-Scaled Array", IEEE AP-S, 2016. pp. 435-436.

Lo, Y.T., "A Mathematical Theory of Antenna Arrays with Randomly Spaced Elements", IDDD Transactions on Antennas and Propagation 12.3, 1964. pp. 257-268.

Mailloux, Robert, Phased Array Antenna Handbook, Ch. 6, vol. 2. Boston: Artech House, 2005. 63 pages.

Mayes, P.E., "Frequency-Independent Antennas and Broad-Band Derivatives Thereof", Proc. of the IEEE, vol. 80, No. 1, Jan. 1992. 10 pages.

Mital et al., "Wideband Multifunction Array Architectures using Wavelength-Scaled Radiating Elements", U.S. Naval Research Lab, 2013 IEEE International Symposium on Phased Array Systems and Technology, pp. 588-592.

Rumsey, Victor H., "Frequency Independent Antennas, Ch. 2 Basic Features of Frequency-Independent Antennas", Academic Press 1966. 11 pages.

Skolnik et al., "Dynamic programming applied to unequally spaced arrays", IEEE Transactions on Antennas and Propagation, 12.1, 1964. pp. 35-43.

Tripp et al., "Frequency-Independent Geometry for a Two-Dimensional Phased Array", IEE Antennas and Propagation Society International Symposium Transmitting Waves of Progress to the Next Millennium,, 2000 Digest. 2000, vol. 2. pp. 628-631.

Tripp, V.K., "The Spiral-Mode Microstrip Antenna—Broad Bandwidth and Low Profile", Proceedings of International Symposium on Electromagnetic Compatibility, Atlanta, Ga., 1995. pp. 108-113.

* cited by examiner

300

500

600a

600b

800

900

1400

SYSTEMS AND METHODS FOR WAVELENGTH SCALED OPTIMAL ELEMENTAL POWER ALLOCATION

CROSS REFERENCE TO RELATED APPLICATIONS

The present application is related to U.S. patent application Ser. No. 15/972,608, filed Jun. 28, 2018, U.S. patent application Ser. No. 16/021,784, filed Jun. 28, 2018, U.S. patent application Ser. No. 16/147,252, filed on Sep. 28, 2018, U.S. patent application Ser. No. 16/142,130, filed on Sep. 26, 2018, and U.S. patent application Ser. No. 16/123,854 filed on Sep. 6, 2018. Each of the above listed applications is incorporated herein by reference in its entirety and assigned to the assignee of the present application.

BACKGROUND

The inventive concepts disclosed herein relate generally to the field of antenna arrays. More particularly, embodiments of the inventive concepts disclosed herein relate to systems and methods for wavelength scaled array layout optimization.

In existing antenna systems, it may be desirable to achieve near frequency independence and extremely wideband antenna performance. Linear log periodic structures may realize a near constant moderate gain and beamwidth over wide frequency ranges, but may have the disadvantages of only moderate gain and wide beamwidths. In addition, existing, uniformly sampled systems require high element counts for a given aperture size in order to operate at both a lowest and highest frequency, an issue which can be exacerbated when the uniformly sampled systems are intended to be used for wideband operation.

SUMMARY

In one aspect, the inventive concepts disclosed herein are directed to an electronically scanned antenna array (ESA) system. The ESA system includes a plurality of first antennas, a plurality of second antennas, a direct current (DC) power supply, a transmit module, and a controller. The plurality of first antennas are configured to operate over a first frequency bandwidth from a first frequency to a second frequency greater than the first frequency. The plurality of second antennas are configured to operate over a second frequency bandwidth from the first frequency to a third frequency greater than the first frequency and less than the second frequency. The transmit module has at least one first control point. The transmit module is configured to receive DC power from the power supply and provide radio frequency (RF) power corresponding to the DC power and the at least one first control point to the plurality of first antennas and the plurality of second antennas. The controller is coupled to the transmit module and to adjust the at least one first control point based on (1) a first predetermined ratio of a first RF signal strength associated with transmission by the plurality of first antennas to a second RF signal strength associated with transmission by the plurality of second antennas, (2) a first passive antenna gain of the plurality of first antennas, and (3) a second passive antenna gain of the plurality of second antennas. The ESA system can include a receive module having at least one second DC bias point. The receive module is configured to receive one or more RF signals from the plurality of first antennas and the plurality of second antennas and apply an electronic gain corresponding to the at least one second DC bias point to the received one or more RF signals. The controller adjusts the at least one second DC bias point based on (1) a second predetermined ratio of a first total receive gain of the plurality of first antennas and the plurality of second antennas, (2) the first passive antenna gain of the plurality of first antennas, and (3) the second passive antenna gain of the plurality of second antennas.

In a further aspect, the inventive concepts disclosed herein are directed to a method of operating an ESA. The method includes identifying, by a controller, a frequency of operation; adjusting, by a controller coupled to a transmit module having at least one first control point, the at least one first control point based on (1) a first predetermined ratio of a first radio frequency (RF) signal strength associated with transmission by the plurality of first antennas to a second RF signal strength associated with transmission by the plurality of second antennas, (2) a first passive antenna gain of the plurality of first antennas, and (3) a second passive antenna gain of the plurality of second antennas; delivering DC power from a DC power supply to the transmit module; and delivering RF power, corresponding to the adjusted at least one first control point and the DC power, to the plurality of first antennas and the plurality of second antennas. The method can include adjusting, by the controller, at least one second control point of a receive module coupled to the controller, based on (1) a second predetermined ratio of a first total receive gain of the plurality of first antennas and the plurality of second antennas, (2) the first passive antenna gain of the plurality of first antennas, and (3) the second passive antenna gain of the plurality of second antennas; receiving, by the receive module, one or more RF signals from the plurality of first antennas and the plurality of second antennas; and applying, by the receive module, an electronic gain corresponding to the adjusted at least one second control point to the one or more RF signals.

BRIEF DESCRIPTION OF THE DRAWINGS

Implementations of the inventive concepts disclosed herein may be better understood when consideration is given to the following detailed description thereof. Such description makes reference to the included drawings, which are not necessarily to scale, and in which some features may be exaggerated and some features may be omitted or may be represented schematically in the interest of clarity. Like reference numerals in the drawings may represent and refer to the same or similar element, feature, or function. In the drawings.

DETAILED DESCRIPTION

Figure 1:
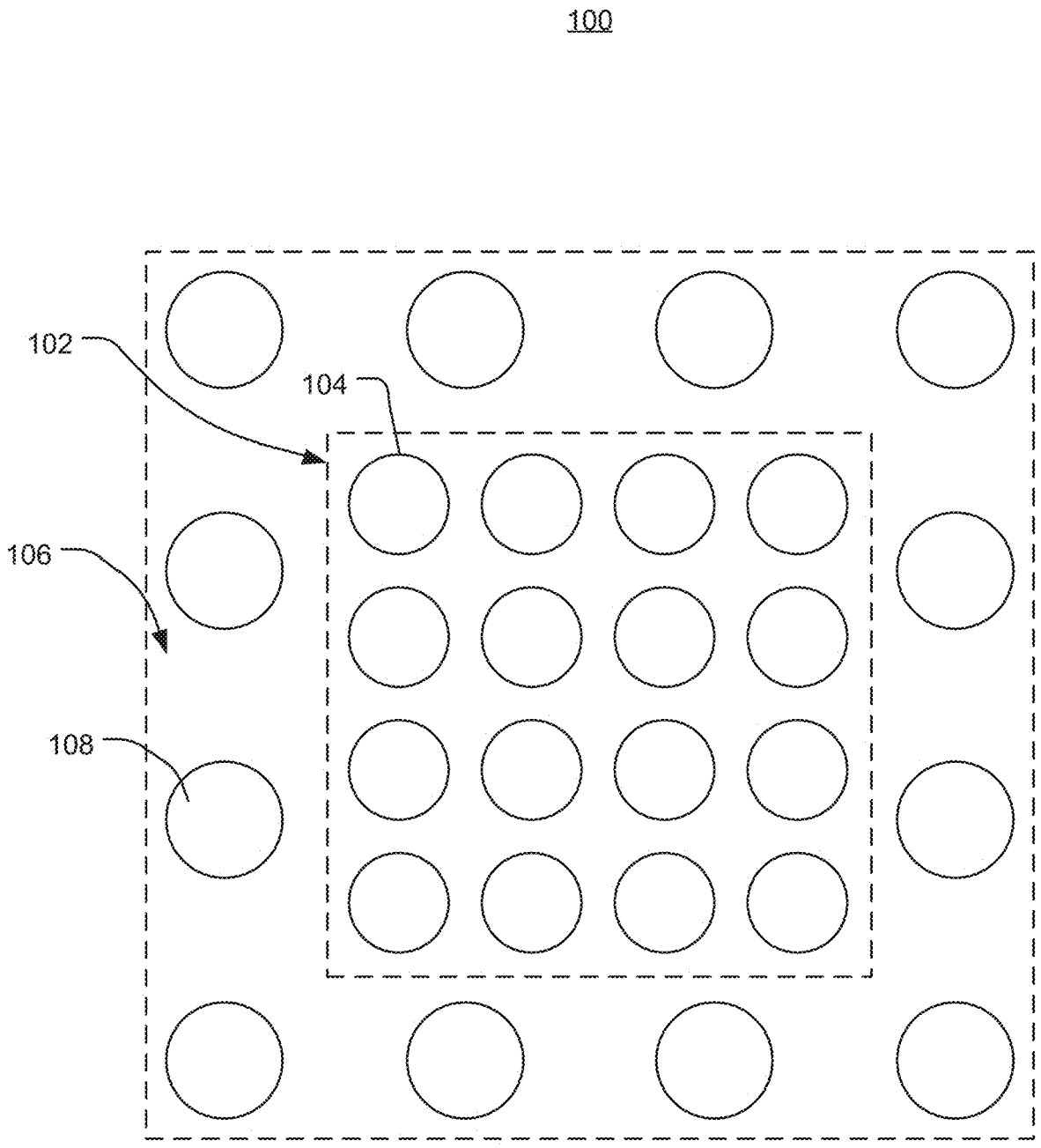
FIG. 1 is a schematic diagram of an exemplary embodiment of a rectangular ESA having two bands according to the inventive concepts disclosed herein.

Before explaining at least one embodiment of the inventive concepts disclosed herein in detail, it is to be understood that the inventive concepts are not limited in their application to the details of construction and the arrangement of the components or steps or methodologies set forth in the following description or illustrated in the drawings. In the following detailed description of embodiments of the instant inventive concepts, numerous specific details are set forth in order to provide a more thorough understanding of the inventive concepts. However, it will be apparent to one of ordinary skill in the art having the benefit of the instant disclosure that the inventive concepts disclosed herein may be practiced without these specific details. In other instances, well-known features may not be described in detail to avoid unnecessarily complicating the instant disclosure. The inventive concepts disclosed herein are capable of other embodiments or of being practiced or carried out in various ways. Also, it is to be understood that the phraseology and terminology employed herein is for the purpose of description and should not be regarded as limiting.

As used herein a letter following a reference numeral is intended to reference an embodiment of the feature or element that may be similar, but not necessarily identical, to a previously described element or feature bearing the same reference numeral (e.g., 1, 1*a*, 1*b*). Such shorthand notations are used for purposes of convenience only, and should not be construed to limit the inventive concepts disclosed herein in any way unless expressly stated to the contrary.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of embodiments of the instant inventive concepts. This is done merely for convenience and to give a general sense of the inventive concepts, and "a" and "an" are intended to include one or at least one and the singular also includes the plural unless it is obvious that it is meant otherwise.

Finally, as used herein any reference to "one embodiment," or "some embodiments" means that a particular element, feature, structure, or characteristic described in connection with the embodiment is included in at least one embodiment of the inventive concepts disclosed herein. The appearances of the phrase "in some embodiments" in various places in the specification are not necessarily all referring to the same embodiment, and embodiments of the inventive concepts disclosed may include one or more of the features expressly described or inherently present herein, or any combination of sub-combination of two or more such features, along with any other features which may not necessarily be expressly described or inherently present in the instant disclosure.

A. Systems and Methods for Wavelength Scaled Array Design Optimization

Broadly, embodiments of the inventive concepts disclosed herein are directed to an electronically scanned antenna array (ESA) system. In some embodiments, the ESA system includes a first band including a plurality of first antennas. Each first antenna is configured to operate over a first frequency bandwidth from a first frequency to a second frequency. The first frequency is less than the second frequency. At least two adjacent first antennas spaced from one another by a first value of a wavelength scale parameter. The first value corresponds to the second frequency. The ESA also includes a second band including a plurality of second antennas. Each second antenna is configured to operate over a second frequency bandwidth from the first frequency to a third frequency. The third frequency is greater than the first frequency and less than the second frequency. At least two adjacent second antennas are spaced from one another by a second value of the wavelength scale parameter. The second value corresponds to the third frequency. At least a second subset of the plurality of second antennas is adjacent to at least a first subset of the plurality of first antennas. The second subset is spaced from corresponding first antennas of the first subset based on the wavelength scale parameter.

The ESA can improve upon existing systems by reducing the number antennas needed to achieve desired operational specifications or performance over a desired bandwidth, which can reduce power consumption, expedite manufacturing, and improve reliability of the operation of the ESA. As will be described herein, the ESA can be used in both planar, rectangular implementations as well as arbitrarily contoured (e.g., non-rectangular) and conformal (e.g., three-dimensional) implementations. The ESA can maintain more consistent gain, beam width, and sidelobe level over a broad bandwidth as compared to a uniformly illuminated structure.

Referring now to FIG. 1, an embodiment of an ESA 100 according to the inventive concepts disclosed herein includes a first band 102 including a plurality of first antennas 104 and a second band 106 including a plurality of second antennas 108. Each first antenna 104 is configured to operate over a first frequency bandwidth from a first frequency to a second frequency, inclusive. The first frequency is less than the second frequency. Operating over the first frequency bandwidth can including both receiving and transmitting at any frequency greater than or equal to the first frequency and less than or equal to the second frequency. In some embodiments, the second frequency is highest frequency of operation of the ESA 100. Each first antenna 104 can have a size (e.g., diameter or other maximum extent across the first antenna 104) on the scale of approximately $10^{-3}$ m to $10^{-2}$ m.

As shown in FIG. 1, the ESA 100 is formed as a rectangular array with each band based on a four by four arrangement of antennas. It will be appreciated that the various ESAs described herein, including the ESA 100, may include varying arrangements of antennas (e.g., two-by-two; three-by-four; the second band 106 may include multiple adjacent arrays such that the second band 106 would include twenty-four antennas 108 rather than the illustrated twelve antennas 108). The ESA 100 can be formed by providing the second band 106, removing interior members from the second band 106 (those which are not shown in FIG. 1), and overlaying the first band 102 on the second band 106.

In some embodiments, the spacing of the antennas of the ESA 100 corresponds to a wavelength scale parameter. The wavelength scale parameter may be indicative of a lattice relaxation factor indicating relaxation of antenna spacing (or relaxation of antenna spacing constraints). The wavelength scale parameter can indicate a density of the antennas of each band of the ESA 100 as a function of position. For example, at least two adjacent first antennas 104 of the first band 102 can be spaced from one another by a first value of the lattice relation factor, where the first value corresponds to the second frequency. Similarly, at least two adjacent antennas 108 of the second band 106 can be spaced from one another by a second value of the wavelength scale parameter, where the second value corresponds to the third frequency. As illustrated in the various ESAs described herein, including the ESA 100, the spacing within bands can change in value from relatively inward bands (e.g., band 102) to relatively outward bands (e.g., band 106). In some embodiments, the antennas of each band have a half-wavelength spacing (e.g., the spacing amongst the antennas 104 of the first band 102 is a half-wavelength, where the wavelength corresponds to the first frequency i.e. wavelength=c/first frequency, where c=speed of light). It will be appreciated a wavelength scaled array is not uniformly distributed, in some embodiments, as compared to uniformly scaled arrays.

As will be described further herein, the values of the wavelength scale parameter can correspond to the positions of the antennas along with the frequency of the band. In a Cartesian coordinate system, the value of the wavelength scale parameter can be a function of x, y, and frequency, where the ESA 100 is configured as a planar array, and x- and y-refer to Cartesian coordinate dimensions. In a three-dimensional coordinate system, such as where the ESA 100 is configured as a three-dimensional array—such as a conformal array configured to conform to a three-dimensional surface of an airborne platform or other platform—the value of the wavelength scale parameter can be a function of x, y, z, and frequency (or may be similarly determined in spherical or cylindrical coordinates as appropriate to the application). The ESA 100 can optimize amplitude, phase shift, and/or time delay excitations for non-uniform lattice spacing to achieve desired far field synthesis. The wavelength scale parameter can be used to define a position of each antenna relative to a reference point, such as a center of the ESA 100, or a peripheral point.

In some embodiments, the wavelength scale parameter is defined based on the following functions:

$$d_i = a * d_{i-1}$$

$$d_i \leq \frac{c}{2 * f_i}$$

where c is the speed of light and $f_i$ is the frequency (e.g., design frequency) for the ith antenna band. For example, antennas within band 1 may be spaced from one another by $d_1$ (where $d_1$ is inversely proportional to the design frequency for band 1 as indicated above), antennas within band 2 may be spaced from one another by $d_2$ (where $d_2$ is inversely proportional to the design frequency for band 2 as indicated above), and antennas within band 2 adjacent to antennas within band 1 may be spaced from the adjacent antennas by $d_2$. In some embodiments, a rectangular element position for the ith antenna band may be defined as follows (n and m being element indices in the x and y directions, respectively):

$$x_n = x_{n-1} \pm d_i$$

$$y_m = y_{m-1} \pm d_i$$

and for various radial geometries (e.g., ESAs 800, 900 described below):

$$r_n = r_{n-1} \pm d_i$$

$$\varnothing_n = \varnothing_{n-1} \pm f(\varnothing, i)$$

where n=1 . . . N and N is the number of elements extending outward in each radial path (e.g., paths along axes 806 of ESA 800; paths along curved arcs 906 of ESA 900).

As shown in FIG. 1, at least a second subset of the plurality of second antennas 108 is adjacent to at least a first subset of the plurality of first antennas 104. For example, as illustrated in FIG. 1, each second antenna 108 is adjacent to the twelve outer antennas 104 of the plurality of first antennas 104 (but not the four inner antennas 104). The second subset of the plurality of second antennas 108 can be spaced from corresponding first antennas 104 of the first subset based on a wavelength scale parameter.

The wavelength scale parameter can correspond to a relationship between the highest frequency of operation of adjacent bands of antennas of the ESA 100. For example, the wavelength scale parameter can correspond to a ratio of the second frequency (the highest frequency of operation of the first band 102) to the third frequency (the highest frequency of operation of the second band 106). As such, the spacing represented by the wavelength scale parameter can correspond to the frequencies of operation of each band of the ESA 100. The size of each of the antennas of the ESA 100 may scale with the wavelength scale parameter.

The ESA 100 can receive a command indicating a frequency for transmission (and/or reception) and control operation of the bands 102, 106 to transmit (and/or receive) at the indicated frequency in response to receiving the command. Each band 102, 106 can simultaneously operate, but at different frequencies (e.g., different frequency sub-bands).

Figure 2:
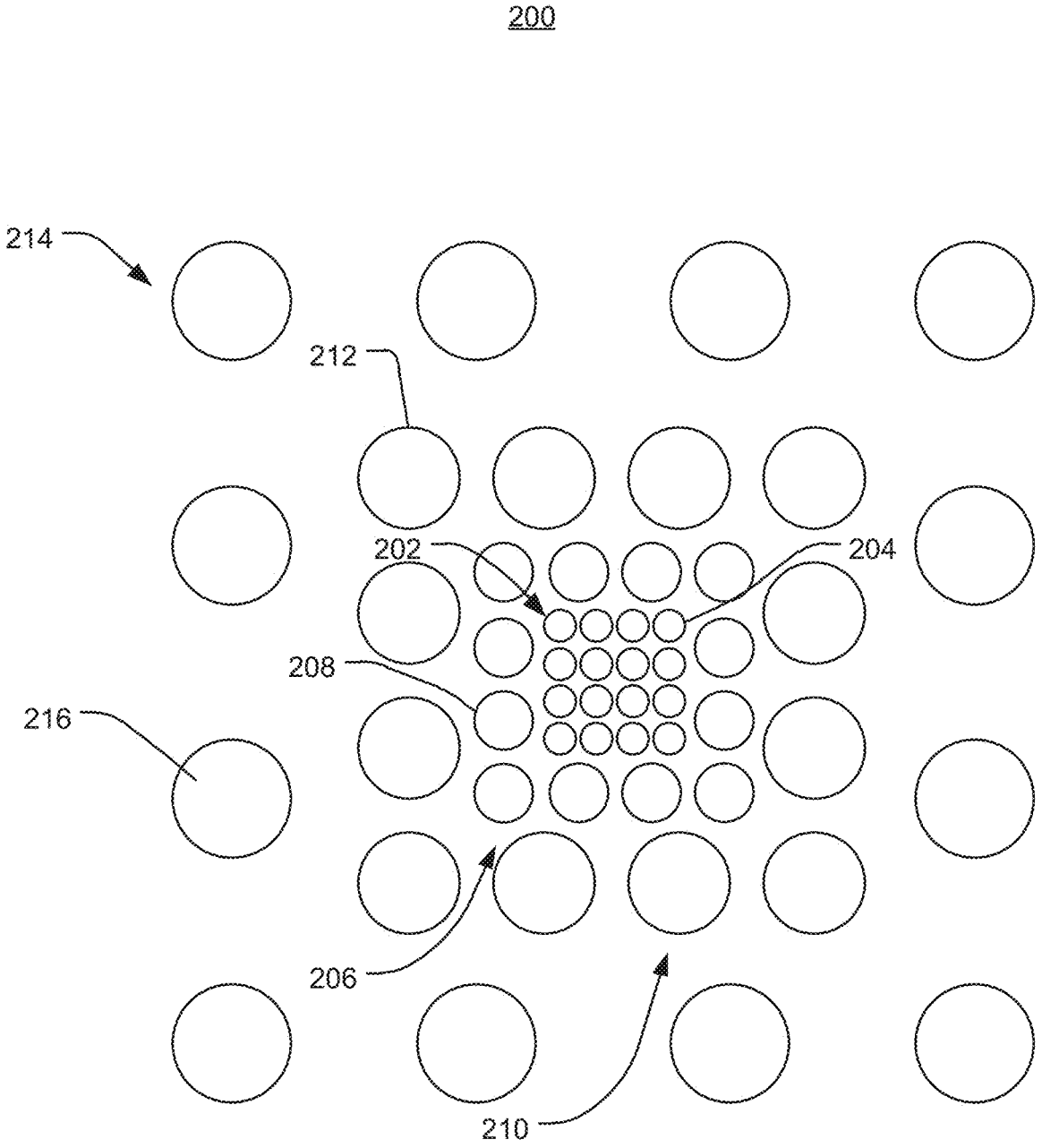
FIG. 2 is a schematic diagram of an exemplary embodiment of a rectangular ESA having four bands according to the inventive concepts disclosed herein.

Referring now to FIG. 2, an embodiment of an ESA 200 according to the inventive concepts disclosed herein includes a first band 202 including a plurality of first antennas 204, a second band 206 including a plurality of second antennas 208, a third band 210 including a plurality of third antennas 212, and a fourth band 214 including a plurality of fourth antennas 216. The ESA 200 is similar to and incorporates features of the ESA 100, except that the ESA 200 includes four bands of antennas.

Similar to the ESA 100, the wavelength scale parameter for the ESA 200 is a continuous scale parameter (e.g., a constant value). The first band 202 is configured to operate from a first frequency to a fifth frequency (the fifth frequency being the highest frequency of operation of the ESA 200). The second band 206 is configured to operate from the first frequency to a fourth frequency, where a ratio of the fifth frequency to the fourth frequency equals the continuous scale parameter. The third band 210 is configured to operate from the first frequency to a third frequency, where a ratio of the fourth frequency to the third frequency is equal to the continuous scale parameter. The fourth band 214 is configured to operate from the first frequency to a second frequency, where a ratio of the third frequency to the second frequency (and of the second frequency to the first frequency) is equal to the continuous scale parameter. In some embodiments, the ESA 200 operates at discrete frequencies corresponding to the first, second, third, and fourth frequencies. It will be appreciated that it can be difficult to provide more than two bands for the ESA 200 without effectively determining the operating frequencies as described herein, particularly for effectively controlling the antennas. At the same time, the ESA 200 can have better performance by providing smoother transitions between band frequencies.

Figure 3:
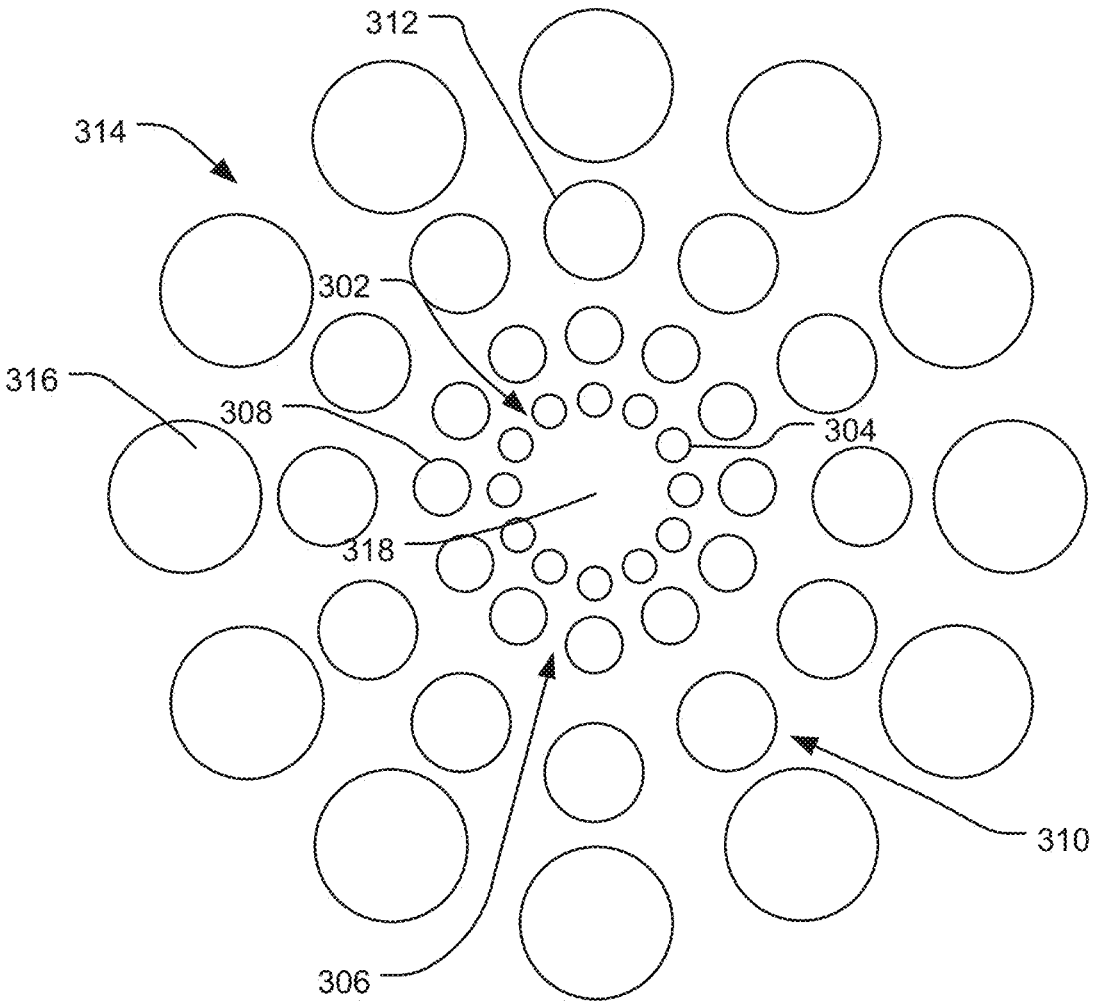
FIG. 3 is a schematic diagram of an exemplary embodiment of a circular ESA according to the inventive concepts disclosed herein.

Referring now to FIG. 3, an ESA 300 is shown according to an embodiment of the inventive concepts disclosed herein. The ESA 300 can incorporate features of the ESAs 100, 200, except that the ESA 300 includes bands of antennas in a circular configuration. As shown in FIG. 3, the ESA 300 includes a first band 302 including a plurality of first antennas 304, a second band 306 including a plurality of second antennas 308, a third band 310 including a plurality of third antennas 312, and a fourth band 314 including a plurality of fourth antennas 316. The ESA 300 may have a circular configuration such that each antenna of each band is equidistant by a radial distance from a center 318 of the ESA 300. The wavelength scale parameter for the ESA 300 as illustrated in FIG. 3 is a continuous scale parameter, though other wavelength scale parameters may also be used; for example, the wavelength scale parameter may be a log scale parameter as described below with reference to FIGS. 5-7. While the ESA 300 is illustrated as having a circular configuration, it will be appreciated that the ESA 300 may have an elliptical configuration (e.g., each antenna is positioned such that each sum of distances from each antenna to two focal points is approximately equal (e.g., within a threshold percentage, such as five percent)). In some embodiments, the circular configuration may be understood to be an example of an elliptical configuration in which the focal points defining the elliptical configuration coincide.

Figure 4B:
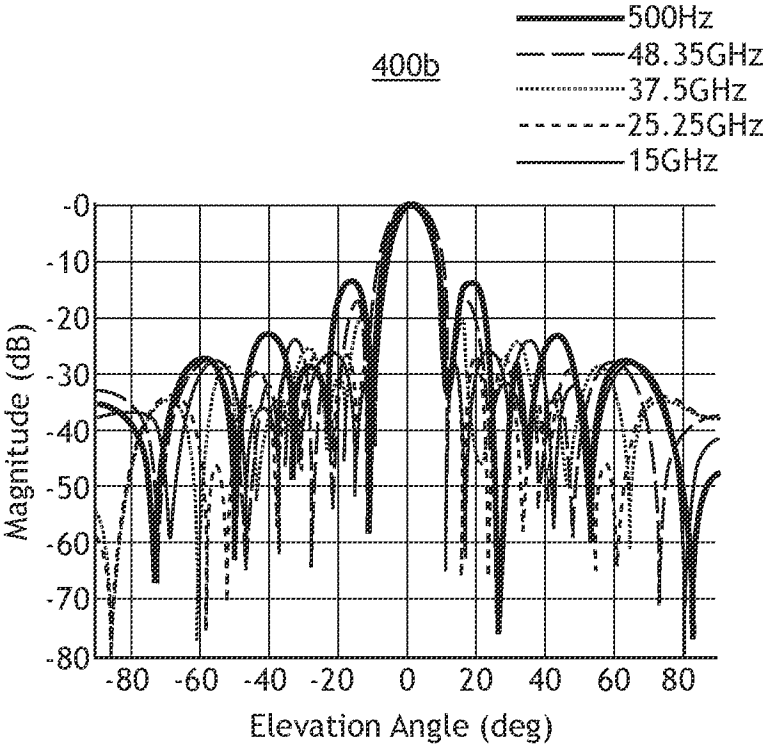
FIGS. 4A-4B are charts of radiation patterns of the circular ESA of FIG. 4.
Figure 4A:
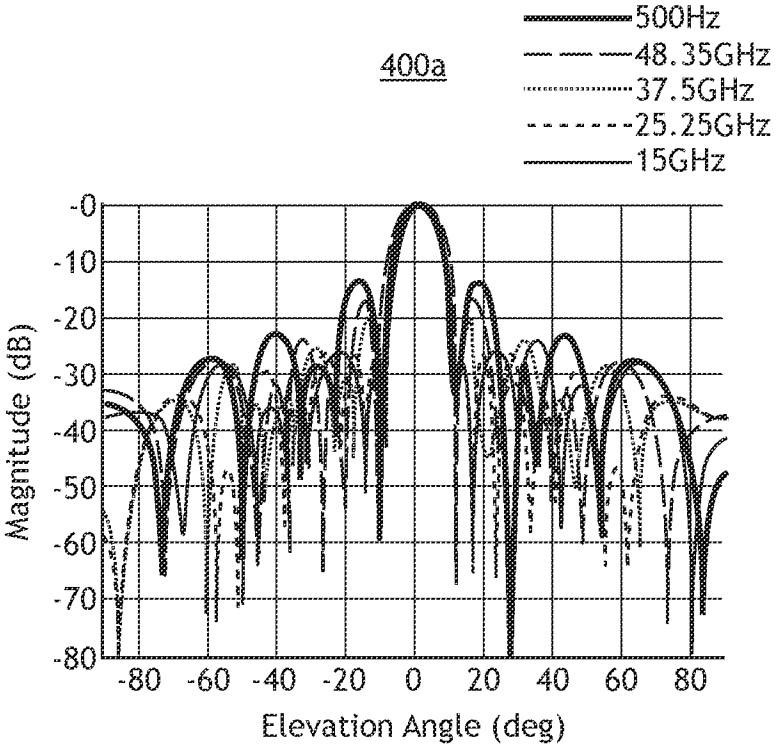

Referring now to FIGS. 4A-4B, charts 400*a*, 400*b* illustrate performance characteristics of the ESA 300 according to an embodiment of the inventive concepts disclosed herein. Chart 400*a* illustrates signal magnitude as a function of elevation angle for each of the five operating frequencies of the ESA 300, indicating consistent magnitude as a function of elevation angle. Similarly, chart 400*b* illustrates consistent signal magnitude as a function of azimuth angle.

Figure 5:
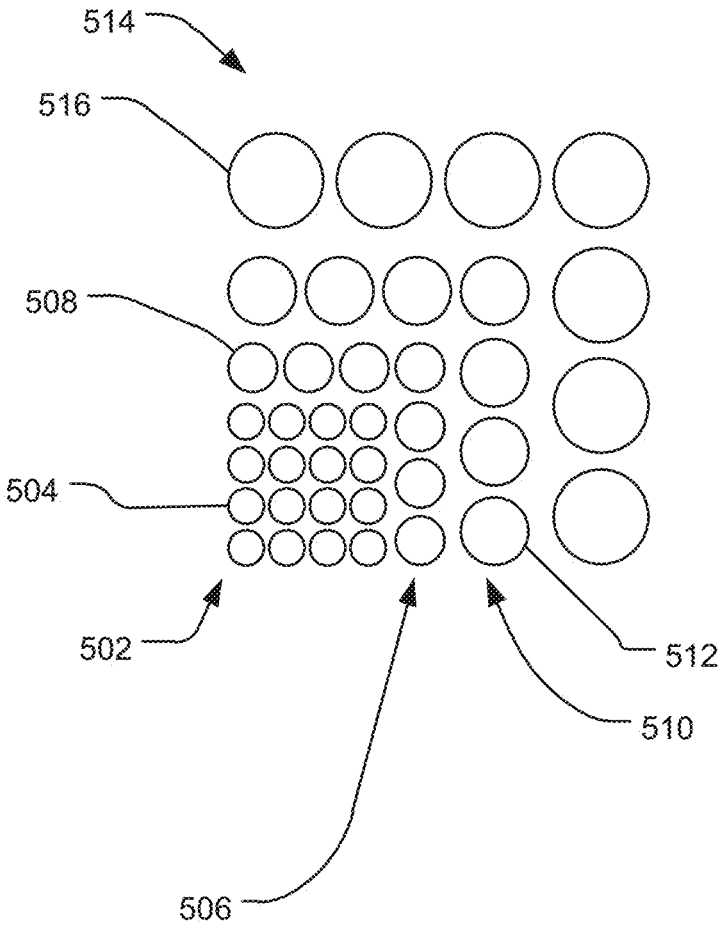
FIG. 5 is a schematic diagram of an exemplary embodiment of a log periodic ESA according to the inventive concepts disclosed herein.

Referring now to FIG. 5, an ESA 500 is shown according to an embodiment of the present disclosure. The ESA 500 can incorporate features of the ESAs 100, 200, 300 described herein, except that the ESA 500 is configured with a log periodically scaled expanding geometry. As shown in FIG. 5, the ESA 500 includes a first band 502 including a plurality of first antennas 504, a second band 506 including a plurality of second antennas 508, a third band 510 including a plurality of third antennas 512, and a fourth band 514 including a plurality of fourth antennas 516. In the illustrated embodiment of FIG. 5, the second antennas 508 of the second band 506 are adjacent to two sides of the array of the plurality of first antennas 504 (and the bands 510, 514 similarly expand from the second band 506). The wavelength scale parameter for the ESA 500 is a log scale parameter, such that values of the log scale parameter vary as a function of an index of each band of the ESA 500, and the variation is based on a logarithm function. For example, the ESA 500 may be configured with a log scale parameter $\tau$ such that $f_{n-1}=f_n/\tau_{n-1}$, where n=1, 2, . . . 4 for the ESA 500, and $\tau$ is less than 1. The bands 504, 506, 508, 510 can each have a half-wavelength spacing between antennas, as the frequency of operation of each band changes based on $\tau$.

Figure 6A:
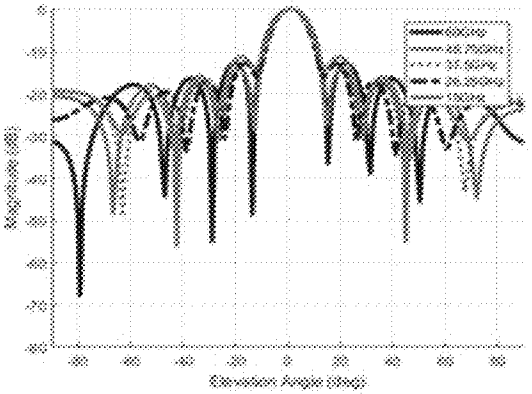
FIGS. 6A-6B are charts of radiation patterns of the log periodic ESA of FIG. 5.
Figure 6B:
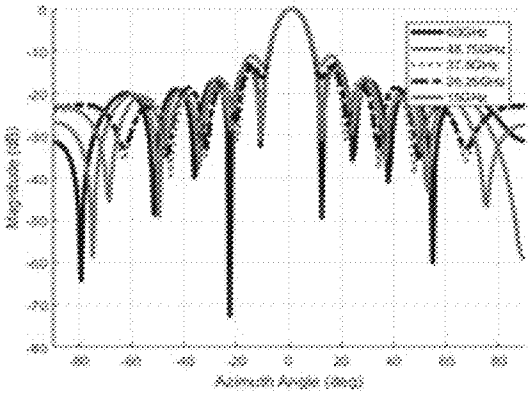

Referring now to FIGS. 6A-6B, charts 600*a*, 600*b* illustrate performance characteristics of the ESA 500 according to an embodiment of the inventive concepts disclosed herein. Similar to charts 400*a*, 400*b*, charts 600*a*, 600*b* illustrate consistent signal magnitude as a function of both elevation angle (chart 600*a*) and azimuth angle (chart 600*b*) for the ESA 500.

Figure 7:
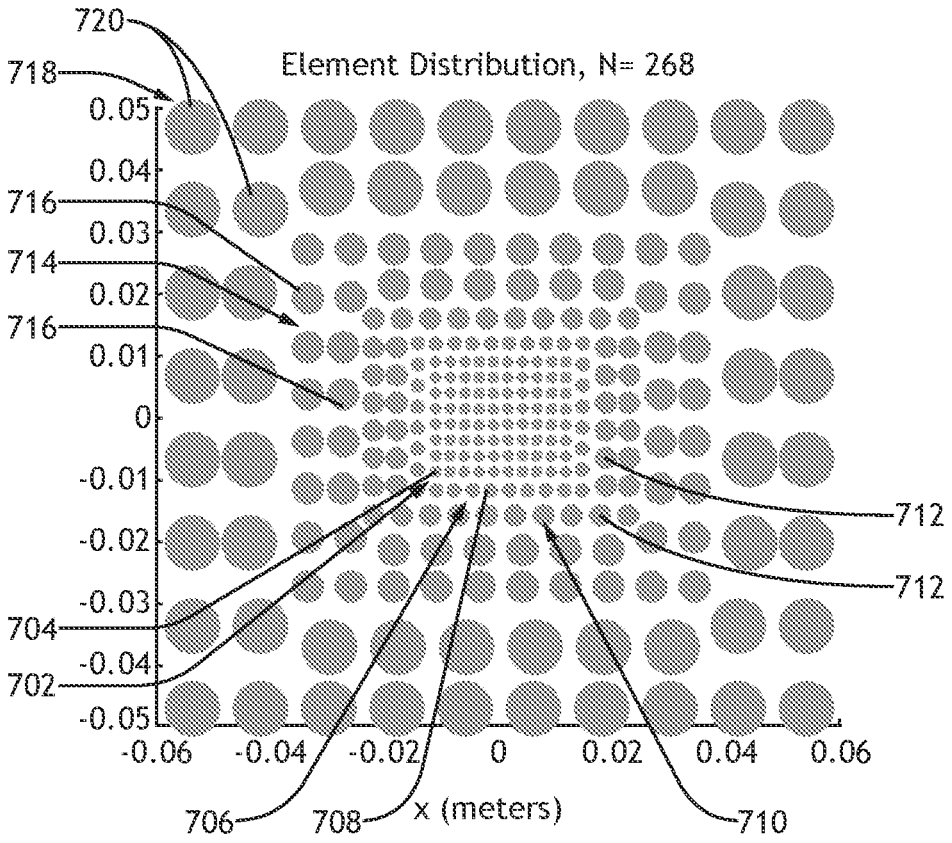
FIG. 7 is a schematic diagram of a centered log periodic ESA according to the inventive concepts disclosed herein.

Referring now to FIG. 7, an ESA 700 is shown according to an embodiment of the present disclosure. The ESA 700 can incorporate features of the ESAs 100, 200, 300, 500 described herein, except that the ESA 700 is configured with a centered log periodically expanding geometry. For example, among each pair of bands of antennas of the ESA 700, the outer band surrounds the inner band. As shown in FIG. 7, the ESA 700 includes a first band 702 including a plurality of first antennas 704, a second band 706 including a plurality of second antennas 708, a third band 710 including a plurality of third antennas 712, a fourth band 714 including a plurality of fourth antennas 716, and a fifth band 718 including a plurality of fifth antennas 720. Each band may include multiple sub-bands of antennas (see, e.g., sub-bands of antennas 712, 716, 720). The ESA 700 has a wavelength scale parameter that is a log scale parameter. The ESA 700 can have advantageous performance due to the quadrant symmetry.

Figure 8:
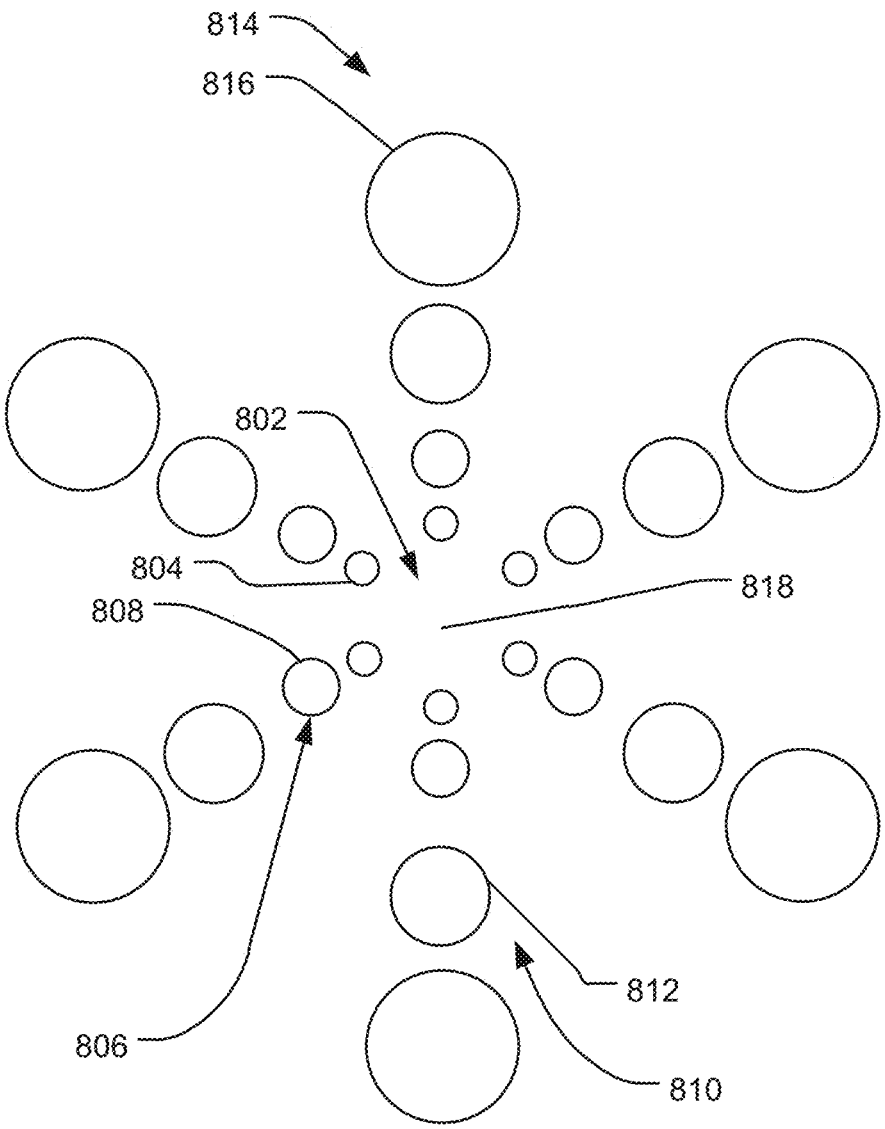
FIG. 8 is a schematic diagram of an ESA having radially expanding bands of antennas according to the inventive concepts disclosed herein.

Referring now to FIG. 8, an ESA 800 is shown according to an embodiment of the present disclosure. The ESA 800 can incorporate features of the ESAs 100, 200, 300, 500, 700. The ESA 800 includes a plurality of bands 802, each band 802 including a plurality of antennas 804. The plurality of bands 802 are arranged to form a plurality of linear paths along a plurality of axes 806. Each axis 806 extends from a center 818 defined by the ESA 800 through one of each of the antennas 804 of the plurality of bands 802. The ESA 800 can incorporate features of some existing arrays, such as the two-dimensional phased arrays described in "Frequency-independent geometry for a two-dimensional phased array" by V.K. Tripp and C.D. Papanicolopoulos. However, unlike such existing two-dimensional phased arrays, such as those that use a different annular ring at each operating frequency, the ESA 800 uses each band 802 having antennas 804 that can operate at or above the particular frequency (e.g., each antenna 804 can have a wide instantaneous bandwidth). For example, to operate at the lowest frequency of operation, the ESA 800 can use every band 802. As such, the ESA 800 can enable constant beamwidths across frequency. As shown in FIG. 8, the ESA 800 has a log scale parameter as the wavelength scale parameter.

Figure 9:
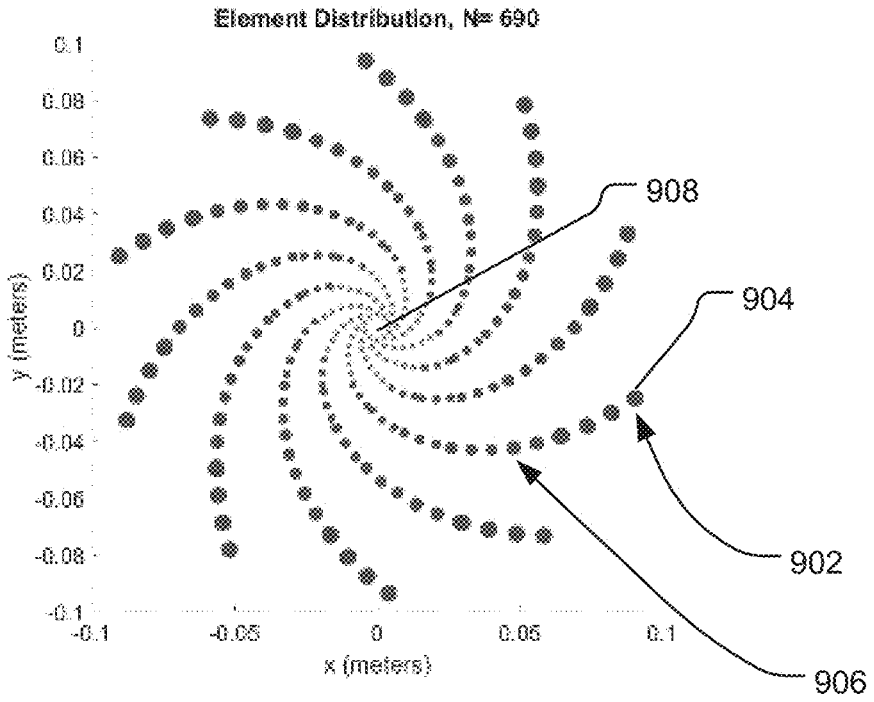
FIG. 9 is a schematic diagram of an ESA having curved radially expanding bands of antennas according to the inventive concepts disclosed herein.

Referring now to FIG. 9, an ESA 900 is shown according to an embodiment of the inventive concepts disclosed herein. The ESA 900 can incorporate features of the ESAs 100, 200, 300, 500, 700, 800. The ESA 900 includes a plurality of bands 902 including antennas 904, and is similar to the ESA 800, except that the plurality of bands 902 are arranged to form a plurality of curved paths along a plurality of curved arcs 906, each arc extending from a center 908 of the ESA 900 (or from a position spaced from the center 908 by a predetermined minimum distance) through the antennas 904 of each curved arc 906. The antennas 904 relatively further from the center 908 can have a greater size than those relatively closer to the center 908. As compared to the ESA 800, the ESA 900 may have relatively higher sidelobe signal magnitude due to the greater spacing (e.g., sparseness) between antennas 904 (relative to antennas 804 of ESA 800). It will be appreciated that the arrangement of antennas 904 of the ESA 900 can also be defined based on a wavelength scale parameter, similar to other ESAs described herein.

In some embodiments, an ESA can be configured in a polygonal or "n-agonal" arrangement (and thus may be similar to the rectangular arrangement of ESA 100 or the arrangement of the ESA 800). For example, the polygonal ESA can be configured in a hexagonal arrangement, though it will be appreciated that other polygonal arrangements, including but not limited to octagonal, nonagonal, and decagonal arrangements may be used as well. The polygonal ESA can be symmetric about a center point. In some embodiments, the polygonal ESA defines a corner aperture. The corner aperture may have a side lobe level less than a threshold side lobe level. In addition, the corner aperture of the polygonal ESA may have an advantageous side lobe position (e.g., placement in a spherical coordinate system based on theta and phi angles).

Figure 10:
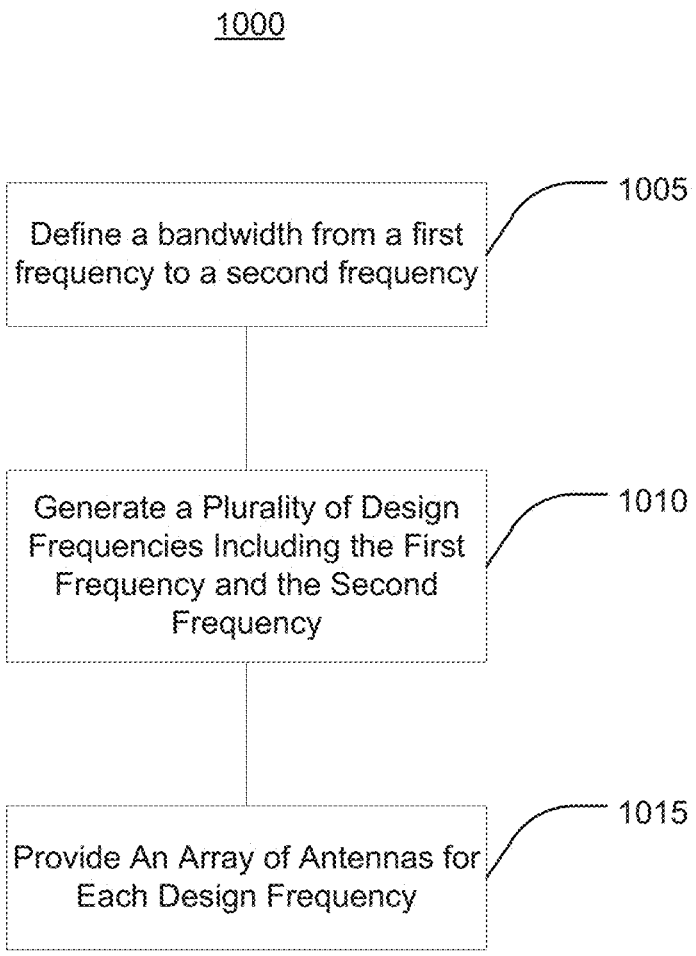
FIG. 10 is a flow diagram of an exemplary embodiment of a method of designing an ESA according to the inventive concepts disclosed herein.

Referring now to FIG. 10, an exemplary embodiment of a method 1000 for designing and/or manufacturing an ESA according to the inventive concepts disclosed herein may include one or more of the following steps. It will be appreciated that the method 1000 may be applied for designing and/or manufacturing various ESAs described herein, including but not limited to the ESAs 100, 200, 300, 500, 700, 800, 900.

A step (1005) may include defining a bandwidth from a first frequency to a second frequency. The first frequency indicates a lowest desired frequency of operation of the ESA, and the second frequency indicates a highest desired frequency of operation of the ESA. In some embodiments, a ratio of the second frequency to the first frequency is at least two to one, such that the ESA can be configured for wideband operation.

A step (1010) may include generating a plurality of design frequencies including the first frequency and the second frequency. In some embodiments, the design frequencies are defined based on a wavelength scale parameter indicating a scaling of the design frequencies. For example, a ratio of each design frequency to at least one of a lower design frequency or a higher design frequency can correspond to the wavelength scale parameter. The first frequency is a lowest frequency of the plurality of design frequencies, and the second frequency is a highest frequency of the plurality of design frequencies. It will be appreciated that for each design frequency other than the lowest frequency or the highest frequency, the ratio of each of such design frequencies to both the next lower and next higher design frequency will be equal to the appropriate wavelength scale parameter. In some embodiments, the wavelength scale parameter is a continuous scale parameter (e.g., a constant, such that the ratio between each pair of adjacent design frequencies is constant). In some embodiments, the wavelength scale parameter may vary as a function of the index of the design frequency. For example, the wavelength scale parameter may be a log scale parameter. The wavelength scale parameter can be determined based on a function of amplitude and delay for a given radiation pattern.

The number of design frequencies may be selected based on expected (e.g., simulated or experimental) performance characteristics of the ESA. For example, generating the plurality of design frequencies can include, for each of a plurality of candidate numbers of design frequencies, determining a corresponding plurality of expected radiation patterns for each design frequency, and identifying the candidate number associated with expected radiation patterns having a highest value of a desired performance characteristic for the ESA. The expected radiation patterns may include at least one of signal magnitude as a function of elevation angle for each design frequency or signal magnitude as a function of azimuth angle for each design frequency.

In some embodiments, the desired performance characteristic includes a consistency of the expected radiation pattern. For example, the consistency may be calculated based on the signal magnitude (as a function of elevation angle and/or azimuth angle) for each design frequency. The consistency may be calculated based on differences in the signal magnitudes (and/or delay/phase) at each elevation angle (and/or azimuth angle) amongst the plurality of design frequencies. The differences in amplitude and phase/time delay that excite each radiating element may be weighted differently in calculating the consistency, such as based on the desired radiation pattern, e.g., the position and/or magnitude of selected side lobes. In some embodiments, the desired performance characteristic includes at least one of the position or the magnitude of the side lobe(s).

A step (1015) may include, for each design frequency, providing an array of antennas. The array of antennas is configured to operate at the corresponding design frequency. For example, the array of antennas can transmit and/or receive a radio frequency signal at the corresponding design frequency. In some embodiments, each antenna within each array is spaced from adjacent antennas within the each array by a half wave spacing. In some embodiments, at least two adjacent antennas of each array are spaced from one another by a value of a wavelength scale parameter corresponding to the corresponding design frequency. In some embodiments, each array of antennas has a same number of antennas.

In some embodiments, the arrays of antennas are provided such that at least a subset of each array is spaced by the wavelength scale parameter from at least one of a corresponding subset for a lower design frequency or a higher design frequency. As such, adjacent arrays of antennas may be spaced from one another by the wavelength scale parameter.

In some embodiments, providing the arrays of antennas includes overlaying the arrays of antennas while removing overlapping antennas. Providing the arrays of antennas can include providing, for the first design frequency (the lowest design frequency), a first array of antennas, removing, from the first array of antennas, a group of antennas corresponding to where addition arrays are to be overlaid, and overlaying, on the first array of antennas, a second array of antennas corresponding to the design frequency which is immediately higher than the first design frequency. This process of removing groups of antennas and overlaying additional antennas (e.g., arrays of antennas) may be repeated as additional arrays are desired. As an example, for an ESA with three design frequencies (a first design frequency, a second design frequency that is greater than the first design frequency, and a third design frequency that is greater than the second design frequency) and a rectangular four-by-four arrangement of antennas, providing the arrays of antennas can include: providing a first, four-by-four array of antennas for the first design frequency; removing the inner two-by-two group of antennas from the first array of antennas; providing a second, four-by-four array of antennas for the second design frequency in the space corresponding to the removed inner first antennas; removing the inner two-by-two-group of antennas from the second array of antennas; and providing a third, four-by-four array of antennas for the third design frequency in the space corresponding to the removed inner second antennas.

Providing the arrays of antennas can be performed to make the ESA a rectangular array ESA. For example, providing the arrays of antennas can include providing a first rectangular array corresponding to the first design frequency, and providing a second rectangular array corresponding to the corresponding to the second design frequency. At least a subset of antennas of the second rectangular array can be adjacent to and outward from the first rectangular array.

In some embodiments, providing the array of antennas includes providing a first circular array corresponding to the first design frequency and a second circular array corresponding to the second design frequency. At least a subset of antennas of the second circular array surrounds the first circular array.

In some embodiments, providing the arrays of antennas includes providing at least a first array and a second array forming a plurality of linear paths along a plurality of axes. Each axis extends through a first antenna of the first array, and a second antenna of the second array adjacent to the first antenna.

Providing the arrays of antennas can be performed by providing at least three arrays of antennas corresponding to at least three design frequencies. The first array, second array, and third array can be arranged to form a plurality of curved paths along a plurality of curved arcs. Each arc can extend from a center point through one of the first antennas of the first array, one of the second antennas of the second array, and one of the third antennas of the third array.

In some embodiments, the arrays of antennas are provided to form a three-dimensional array, which can be made conformal to a three-dimensional surface, such as a surface of an airborne platform.

As will be appreciated from the above, ESAs according to embodiments of the inventive concepts disclosed herein may improve upon existing systems by reducing the total number of antenna elements required by not requiring all elements to operate at all frequencies, which can improve manufacturing yield and operational reliability; enabling optimized radiating element and radio frequency hardware implementation across the sub-band regions that make up the wavelength scaled array; and, in some embodiments, removing the constraint of half-wave lattice sampling at the highest operating frequency of the ESA, which can create a significant oversampling disadvantage at lower operating frequencies.

B. Systems and Methods for Wavelength Scaled Array Elemental Power Allocation

Broadly, embodiments of the inventive concepts disclosed herein are directed to an ESA system that includes a plurality of first antennas, a plurality of second antennas, a direct current (DC) power supply, a transmit module, and a controller coupled to the plurality of first antennas, the plurality of second antennas, and the DC power supply. The plurality of first antennas are configured to operate over a first frequency bandwidth from a first frequency to a second frequency greater than the first frequency. The plurality of second antennas configured to operate over a second frequency bandwidth from the first frequency to a third frequency greater than the first frequency and less than the second frequency. The transmit module has at least one first control point. The transmit module is configured to receive DC power from the power supply and provide radio frequency (RF) power corresponding to the DC power and the at least one first control point to the plurality of first antennas and the plurality of second antennas. The controller is coupled to the transmit module and to adjust the at least one first control point based on (1) a first predetermined ratio of a first RF signal strength associated with transmission by the plurality of first antennas to a second RF signal strength associated with transmission by the plurality of second antennas, (2) a first passive antenna gain of the plurality of first antennas, and (3) a second passive antenna gain of the plurality of second antennas. The ESA system can include a receive module having at least one second control point that the controller can adjust based on a (1) second predetermined ratio of a first total receive gain of the plurality of first antennas and the plurality of second antennas, (2) the first passive antenna gain of the plurality of first antennas, and (3) the second passive antenna gain of the plurality of second antennas.

The present solution can enable ESAs which can operate at ultra-ultrawideband, with greater than a 10:1 instantaneous bandwidth. The ESA can be independently steered, with multi-beam operation. The ESA can operate from ultra high frequency (UHF) through W band frequencies. The ESA can provide wide scan volume coverage, such as a greater than sixty degree conical volume coverage. The ESA can have modular sub-arrays, and can conform to arbitrary double-curved surfaces.

The ESA system can improve upon existing systems by reducing antenna (element) counts and more effectively allocating power to each antenna. For example, the ESA system can use differences in passive antenna gains of the first antennas and the second antennas to adjust a control point of a transmit module that delivers RF power delivered to each antenna, such as to reduce power delivered to the first antennas when the first antennas have higher passive antenna gain than the second antennas. Similarly, the ESA system can use differences in passive antenna gains of the first antennas and the second antennas to adjust an electronic RF gain of a receive module that receives RF signals from each antenna. For example, the effective power (e.g., effective isotropic radiative power (EIRP)) when each antenna transmits can be represented as the passive antenna gain of the antenna multiplied by the RF power delivered to the antenna, and the total receive gain of each antenna (e.g., per channel) can be represented by the passive antenna gain of the antenna multiplied by the electronic RF gain of the receive module. The ESA system can adjust the RF power delivered to each antenna and/or electronic gain applied to received signals while maintaining desired RF performance factors, such as linearity across the antenna aperture. The ESA system can have increased reliability and reduced size, weight, power, and cost (SWAP-C) requirements by reducing antenna (element) counts and associated redundancy, transmit/receive module count, RF interconnect density, and oversampling. The ESA system can have improved thermal flux density by reducing power consumption and reducing antenna density.

Figure 11:
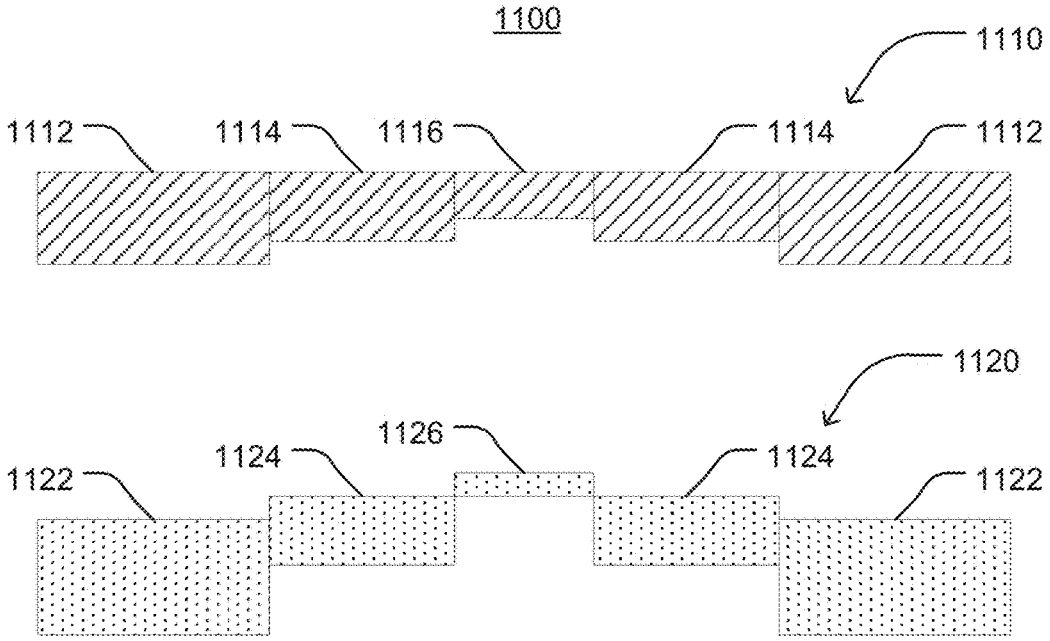
FIG. 11 is a schematic diagram of an exemplary embodiment of an aperture layer and a feed layer of an ESA according to the inventive concepts disclosed herein.
Figure 12:
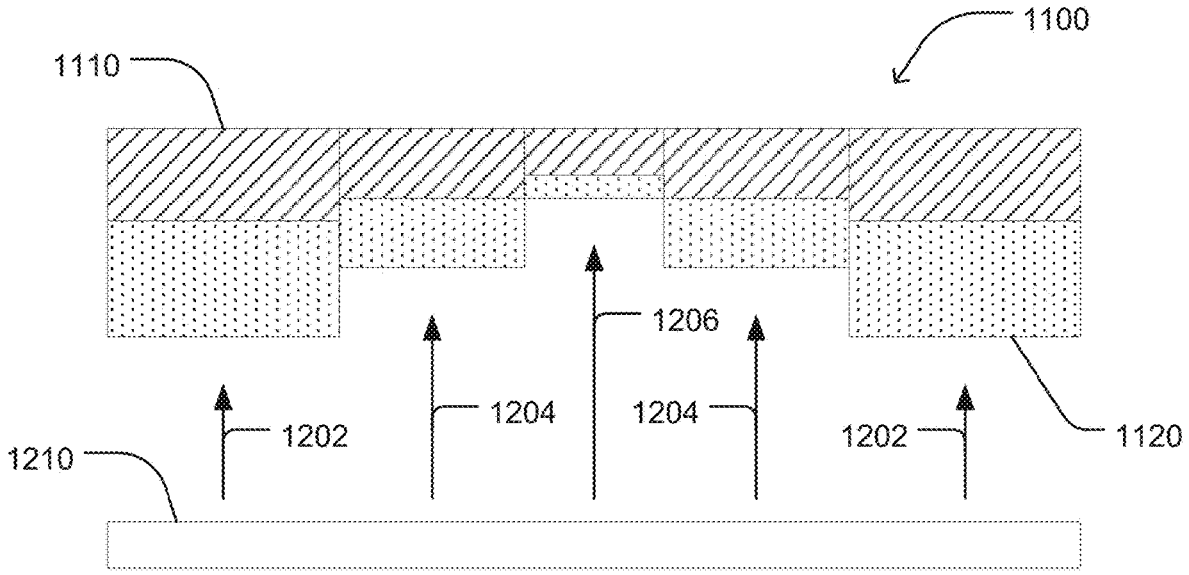
FIG. 12 is a schematic diagram of the ESA of FIG. 11 as assembled and including an m-plexor layer.

Referring now to FIGS. 11-12, an ESA 1100 according to an exemplary embodiment of the inventive concepts disclosed herein can include a radiation layer 1110 and a feed layer 1120. The ESA 1100 can be a wavelength scaled array, and can incorporate features of the ESAs described herein, including the ESA 300. The ESA 1100 can include features of the ESAs disclosed in U.S. patent application Ser. No. 15/160,959, which is incorporated herein by reference.

The radiation layer 1110 includes a first aperture region 1112, a second aperture region 1114, and a third aperture region 1116. The first aperture region 1112 is outward from the second aperture region 1114, which is outward from the third aperture region 1116. The first aperture region 1112 can be configured for a first frequency range, the second aperture region 1114 can be configured for a second frequency range greater than the first frequency range, and the third aperture region 1116 can be configured for a third frequency range greater than the second frequency range.

The feed layer 1120 includes a first feed region 1122, a second feed region 1124, and a third feed region 1126. The first feed region 1122 is outward from the second feed region 1124, which is outward from the third feed region 1126. The feed regions 1122, 1124, 1126 can provide connections as well as processing for signals received and transmitted by the ESA 1100. As shown in FIGS. 11-12, the feed regions 1122, 1124, 1126 can be coupled respectively to the feed regions 1122, 1124, 1126, and can respectively operate in the first frequency range, second frequency range, and third frequency range.

In some embodiments, an m-plexor layer 1210, such as a diplexor layer, can be provided. The m-plexor layer 1210 can be a passive device that implements frequency domain multiplexing by receiving and providing signals associated with the aperture regions 1112, 1114, 1116 via the feed regions 1122, 1124, 1126.

The ESA 1100 has a first sub-band 1202 corresponding to the first feed region 1122 and first aperture region 1112, a second sub-band 1204 corresponding to the second feed region 1124 and second aperture region 1114, and a third sub-band 1206 corresponding to the third feed region 1126 and third aperture region 1116. The ESA 1100 can be configured such that each sub-region (e.g., first feed region 1122/first aperture region 1112, etc.) has a different aperture, feed manifold, and RF electronic packaging and interconnect architectures and/or topologies, enabling more precise control over operation of each sub-region. For example, aperture radiating elements, RF feed manifold, RF integrated circuit (RFIC) RF signal, direct current (DC), control, and ground interconnect can be individualized for each sub-region. Typically, the regions that can operate at the highest frequency can be the most complex to design and manufacture because of small aperture radiating element spacings and lattice density sizes relative to RFIC packaging and interconnect dimensions; as described further herein, the present solution can enable optimization of the ESA 1100 design and manufacture, including to reduce DC power consumption, while accounting for such considerations.

Figure 13:
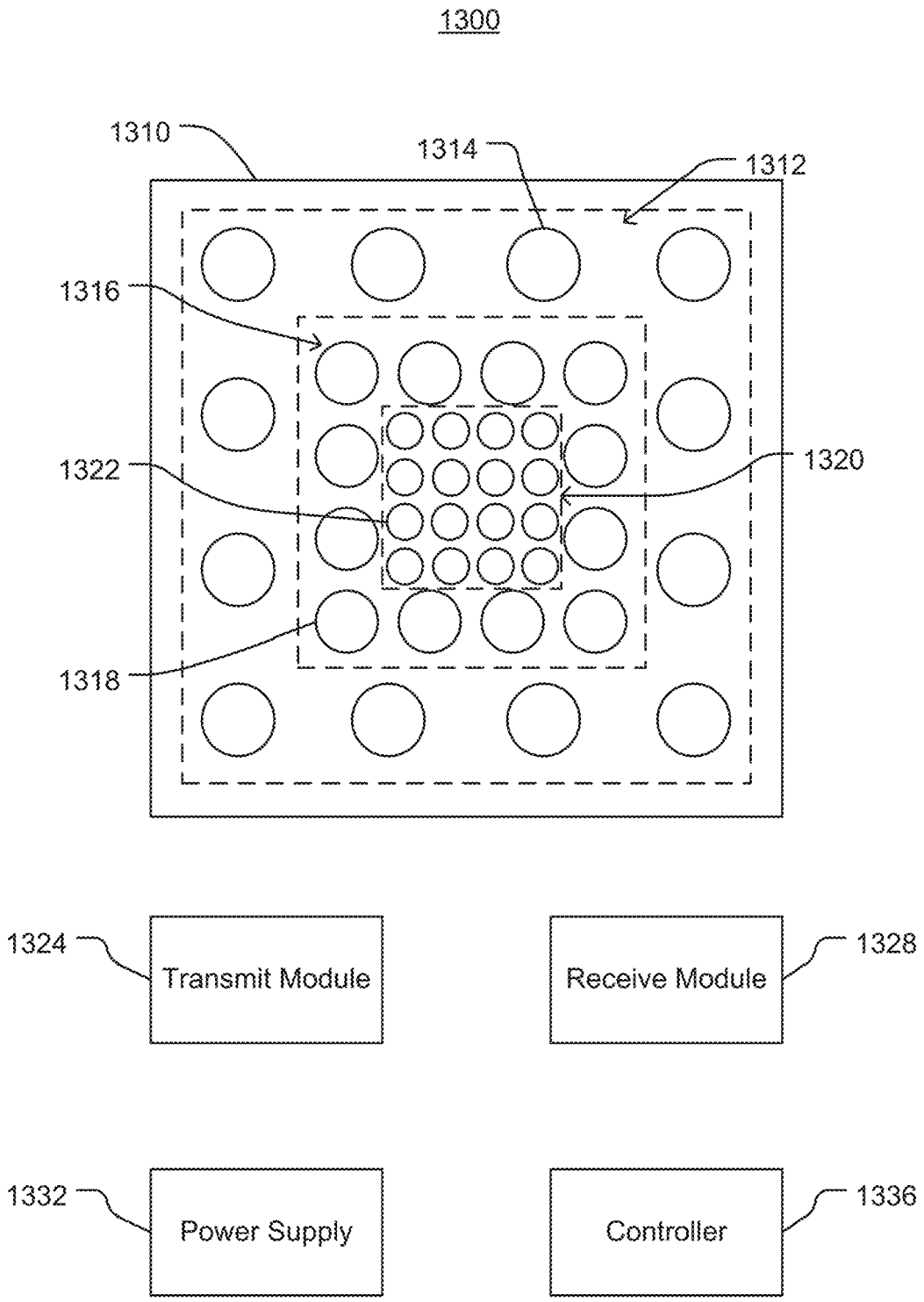
FIG. 13 is a schematic diagram of an exemplary embodiment of an ESA system that can execute elemental power allocation according to the inventive concepts disclosed herein.

Referring now to FIG. 13, an ESA system 1300 according to an exemplary embodiment of the inventive concepts disclosed herein includes an ESA 1310, a transmit module 1324, a receive module 1332, and a controller 1336.

The ESA 1310 can incorporate features of various ESAs described herein, including the ESAs 100, 200, 300, 500, 700, 800, and 900. As depicted in FIG. 13, the ESA 1310 includes a first sub-band 1312 including a plurality of first antennas 1314, a second sub-band 1316 including a plurality of second antennas 1318, and a third sub-band 1320 including a plurality of third antennas 1322. In accordance with the inventive concepts disclosed herein, the ESA 1310 can be configured such that a lattice density (e.g., corresponding to the wavelength scale parameter described above) can be minimized for a given instantaneous bandwidth. The ESA 1310 can operate as a quasi-constant beam width structure. The plurality of first antennas 1314 can operate over a first frequency bandwidth (e.g., frequency range) from a first frequency to a second frequency greater than the first frequency. The plurality of second antennas 1318 can operate over a second frequency bandwidth from the first frequency to a third frequency that is greater than the first frequency and less than the second frequency. The plurality of third antennas 1322 can operate over a third frequency bandwidth from the first frequency to a fourth frequency that is greater than the first frequency and less than the third frequency (e.g., first frequency<fourth frequency<third frequency<second frequency). As an example, the first frequency can be 10 GHz, the second frequency can be 60 GHz, the third frequency can be 42 GHz, and the fourth frequency can be 26 GHz, so that the first sub-band 1312 can operate from 10 GHz to 60 GHz, the second sub-band 1316 can operate from 10 GHz to 42 GHz, and the third sub-band 1320 can operate from 10 GHz to 26 GHz. In some embodiments, the first sub-band 1312 may not necessarily operate all the way down to the first frequency; for example, continuing the example above, the first sub-band 1312 may operate from 26 GHz to 60 GHz.

The wavelength scale parameter of the design of the ESA 1310, which relaxes the element lattice spacing outwardly from the center to the perimeter, can enable the ESA 1310 to operate with no grating lobes. While FIG. 13 depicts the ESA 1310 as including three sub-bands and corresponding numbers of antennas within each sub-band, the arrangement of and number of sub-bands and antennas in each sub-band can be varied in accordance with the inventive concepts described herein regarding wavelength scaled array design optimization. For example, the ESA 1310 may be arranged in a manner analogous to the ESA 500 described with reference to FIG. 5, in which a band operating at a highest frequency is in a corner of the ESA 500.

The power for operating each of the first antennas 1314, second antennas 1318, and third antennas 1322 can be, for a given frequency, a function of the area of each antenna (e.g., proportional to $\pi r^2$, where r is the radius of the antenna). As such, the power for operating each antenna can increase with antenna size, with more central antennas using less power than more outward antennas in the configuration shown in FIG. 13, due to the relatively higher passive antenna gain at the relatively higher frequencies.

Each antenna 1314, 1318, 1322 has a corresponding passive antenna gain, which varies as a function of the frequency at which the antenna 1314, 1318, 1322 operates. In some embodiments, because the ESA 1310 is configured to use the wavelength scale parameter to determine lattice spacing (e.g., spacing among antennas 1314, 1318, 1322), such as to prevent grating lobes by having a lattice spacing corresponding to a wavelength scale parameter based on the first frequency.

To operate at the highest frequencies (e.g., within the first frequency bandwidth), the ESA 1310 can use the central plurality of first antennas 1314. At such frequencies, there will not be lattice density oversampling. To operate at middle frequencies (e.g., within the second frequency bandwidth), the ESA 1310 can use the first antennas 1314 and the second antennas 1318. At such frequencies, there may be a relatively small amount of array lattice density oversampling, and the input power received by each antenna 1314, 1318 can change by an amount less than a threshold change amount within the middle of the ESA 1310. To operate at low frequencies (e.g., within the third frequency bandwidth), the ESA 1310 can use the first antennas 1314, the second antennas 1318, and the third antennas 1322. At such frequencies, there may be a minimized amount of lattice density oversampling, and the input power received by each antenna 1314, 1318, 1322 can change by an amount greater than the threshold change amount from the center to the perimeter of the ESA 1310.

The transmit module 1324 (e.g., transmit circuitry channel(s) coupled to the antennas of the ESA 1310) can provide RF power levels to each antenna of the ESA 1310 based on at least one first control point as programmed by the controller 1336, which optimizes power received from the power supply 1332. The at least one first control point can include various controls, such as a DC bias level, one or more gains (e.g., cascaded gains), phase control, time delays, RF linearity control, frequency control, or various combinations thereof that result in a change in how the transmit module 1324 generates the RF power (and corresponding signal for output) provided to the antennas of the ESA 1310. In some embodiments, the transmit module 1324 includes a power amplifier that amplifies power received from the power supply 1332. The power amplifier can include a bias element including at least one of a low noise amplifier, a variable gain amplifier, a phase shifter, or a mixer. The transmit module 1324 can have a first DC bias point (e.g., Q-point; operating bias point; bias point of DC voltage and/or DC current) that can be adjusted based on a received control signal to adjust the DC power to provide the RF power to the antennas of the ESA 1310. The transmit module 1324 can have a plurality of first DC bias points for independently delivering RF power to each sub-band (and/or each antenna) of the ESA 1310.

The receive module 1328 (e.g., receive circuitry channel(s) coupled to the antennas of the ESA 1310) can receive RF signals from the ESA 1310, and apply an electronic gain to the received RF signals to enable further signal manipulation and processing. The receive module 1328 can have at least one second control point associated with the electronic gain and that can be programmed by the controller 1336; the at least one second control point can include various controls, such as DC bias level, one or more gains (e.g., cascaded gains), phase control, time delays, RF linearity control, frequency control, or various combinations thereof that result in a change in how the receive module 1328 modifies the signals received from the antennas of the ESA 1310 for downstream processing. In some embodiments, the receive module 1328 includes an amplifier, such as a low noise amplifier, that applies the electronic gain to the received signals. The receive module 1328 can have a second DC bias point ((e.g., Q-point; operating bias point; bias point of DC voltage and/or DC current) that can be adjusted based on a received control signal to adjust the electronic gain. The receive module 1324 can have a plurality of second DC bias points for independently applying electronic gain to signals received from each sub-band (and/or each antenna) of the ESA 1310.

The controller 1336 can generate control signals to control operation of the transmit module 1324 and the receive module 1328, including to adjust the first control points of the transmit module 1324 and the second control points of the receive module 1328. For example, by adjusting the DC bias points, e.g., the voltage and currents of the DC power provided from the power supply 1332 to the RF circuits of the transmit module 1324 and the receive module 1328, the RF power provided by the transmit module 1324 to the antennas of the ESA 1310, and the RF electronic gain of the receive module 1328, can be adjusted to account for the changes in the passive element gain of the antennas of the ESA 1310. For example, the controller 1336 can control operation of the transmit module 1324 and/or the receive module 1328 based on a desired frequency (or frequency range) of operation of the ESA 1310. The controller 1336 can include one or more RFICs. In some embodiments, the controller 1336 controls operation of the transmit module 1324 (or the receive module 1328) to adjust the RF power delivered to each sub-band 1314, 1318, 1322 (or the electronic gain applied to signals received from each sub-band 1314, 1318, 1322) based on a frequency of operation of the corresponding sub-band 1312, 1316, 1320. The controller 1350 can adjust the power delivered to each individual antenna 1314, 1318, 1322 (or the electronic gain applied to signals received from each individual antenna 1314, 1318, 1322). The controller 1336 can use the different passive antenna gains of the different antennas 1314, 1318, 1322 to effectively reduce and/or minimize DC power consumption while maintaining appropriate RF performance.

Figure 14:
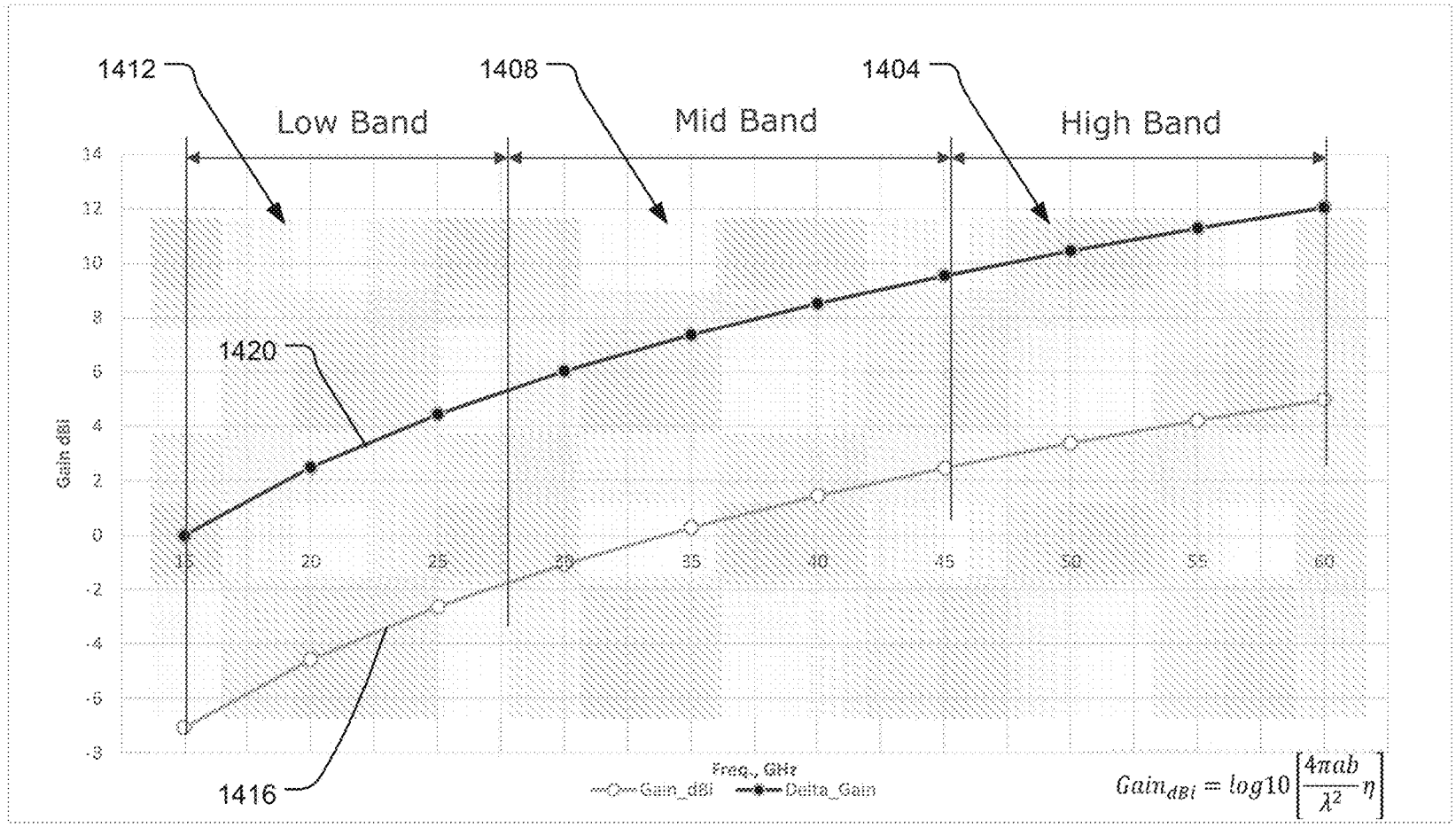
FIG. 14 is a chart of an exemplary embodiment of antenna gain as a function frequency according to the inventive concepts disclosed herein.

Referring now to FIG. 14, a chart 1400 according to an exemplary embodiment of the inventive concepts disclosed herein depicts passive antenna gain of an ESA, such as the ESA 1300, as a function of frequency. Chart 1400 depicts passive antenna gain of an ESA having three sub-bands 1404, 1408, 1412. The first, high sub-band 1404 can operate from the first frequency of 15 GHz to a second frequency of 60 GHz. The second, middle sub-band 1408 can operate from the first frequency of 15 GHz to a second frequency of 45 GHz. The third, low sub-band 1412 can operate from the first frequency of 15 GHz to a third frequency of 26 GHz.

Chart 1400 includes an absolute antenna gain curve 1416 illustrating the absolute passive antenna gain in dBi (e.g., ratio of power density produced by the antenna relative to power density produced by hypothetical lossless isotropic antenna, in decibels). As shown in FIG. 14, the absolute passive antenna gain 1416 increases with frequency. For example, the absolute passive antenna gain 1416 can be lowest at the lowest frequency, and highest at the highest frequency. In some embodiments, the absolute passive antenna gain 1416 increases with frequency because the size of the antennas (e.g., radiating elements) is optimized for operation of the highest frequency antennas, such as to fit in the highest frequency antennas at the center of the ESA.

Chart 1400 also includes a normalized gain curve 1420 illustrating the passive antenna gain normalized relative to the gain at the lowest frequency (e.g., first frequency). The normalized gain curve 1420 illustrates the normalized gain that can result for each sub-band; in particular, the normalized gain curve 1420 increases with frequency. The passive gain associated with each antenna, and thus the corresponding normalized passive gain, can be a function of the antenna size/geometry and the frequency of operation. For example, the high sub-band 1412 can have a normalized gain of 12 dB (e.g., at the first frequency), the middle sub-band 1408 can have a normalized of approximately 9 dB, and the lower sub-band can have a normalized gain of approximately 5 dB.

As such, and referring back to FIG. 13, the ESA system 1300 can use the increasing passive antenna gain of the antennas of the ESA 1310, and the ability of the controller 1336 to adjust the control points of the transmit module 1324 and the receive module 1328, to minimize DC power consumption while maintain proper RF performance. For example, the controller 1336 can maintain RF linearity (e.g., constant or near constant signal strength across the frequencies of operation of the ESA 1310) by adjusting control points so that less DC power is used in regions/frequencies of operation of the ESA 1310 at which the antennas of the ESA 1310 have relatively greater passive antenna gain. In some embodiments, the controller 1336 can control the receive module 1328 by increasing gain in frequencies/regions at which greater loss occurs (e.g., passive antenna gain is less), while reducing DC power consumption having relied on the electronic gain to overcome the extra loss. The controller 1336 can implement power control using bias control of the first DC bias point of the transmit module 1324 and the second DC bias point of the receive module 1328 for current variation and voltage variation. The controller 1336 can set the first and/or second DC bias points so that less DC power is used from the power supply 1332 for antennas of the ESA 1310 operating at relatively higher frequencies, due to the relatively higher passive antenna gain of the antennas of the ESA 1310 operating at relatively higher frequencies. As an illustrative example, the ESA system 1300 can include millimeter wave cascades that maintain 10 GHz to 60 GHz coverage, and the controller 1336 can generate controls signals to control the first and second DC biases to execute a voltage supply variation with a 1.3 to 1 ratio, and execute a current supply variation with at least a 2 to 1 ratio. As such, the controller 1336 can vary the DC power consumption with at least a 2.6 to 1 ratio. Because the saturation power of an RF amplifier can vary as a square of the current (e.g., saturation power is proportional to current times resistance), a 2 to 1 current supply variation can enable a 4 to 1 saturation power variation, and thus a 6 dB change in saturation power for a halving of the DC supply current by the controller 1336. In some embodiments, the controller 1336 can reduce the voltage supply, without voltage clipping, which can increase DC power consumption savings without impacting the saturation power. As such, the controller 1336 can maintain the 10-60 GHz millimeter wave bandwidth, using a 2.6 to 1 DC power consumption ratio and a corresponding 4 to 1 RF linearity ratio.

In some embodiments, the controller 1336 executes the control point adjustment based on at least one of a desired RF channel gain (e.g., amplification of the DC power used by the transmit module 1324; electronic gain applied by the receive module 1328) or desired $P_{1dB}$ (power at the 1 dB compression point). For example, the controller 1336 can maintain at least one of a function or a database mapping the passive antenna gain of the antennas of ESA system 1300 to the corresponding frequency. The controller 1336 can use the at least one of the function or the database to determine the antenna gain for the desired frequency of operation, and then calculate the control point adjustment (e.g., current adjustment and/or voltage adjustment if DC bias adjustment is being performed) in order to achieve the desired RF channel gain and/or desired $P_{1dB}$.

In some embodiments, the controller 1350 executes the DC bias adjustment by setting the first control point (of the transmit module 1324) corresponding to the first sub-band 1312 to a first value, setting the first control point corresponding to the second sub-band 1316 to a second value, and setting the first control point corresponding to the third sub-band 1320 to a third value. The controller 1350 can determine the first value, second value, and third value, and thus the resulting based on one or more predetermined ratio(s) corresponding to the passive antenna gain as a function of desired operating frequency for the ESA 1310. In some embodiments, the predetermined ratio is a ratio for the signal strength (e.g., EIRP) of the signal outputted by the ESA 1310 by each sub-band 1312, 1316, 1320. For example, if the normalized passive antenna gain is 12 dB for the first sub-band 1312, and 5 dB for the third sub-band 1320, the controller 1336 can adjust the first control point of the transmit module 1324 to reduce the first value, and thus the amount of RF power delivered to the first sub-band 1312 by the transmit module 1324, based on the 12 dB normalized antenna gain for the first sub-band 1312 versus the 5 dB normalized passive antenna gain for the third sub-band 1320 based on the corresponding predetermined ratio (e.g., if the predetermined ratio is 1 to 1 so that the RF signal strength is to be linear, the controller 1336 can adjust the first control point to reduce the first amount of RF power relative to the third amount of RF power so that the signal strength of the RF signal transmitted by the first sub-band 1312 equals the RF signal strength of the signal transmitted by the third sub-band 1320). As such, the controller 1336 can reduce DC power consumption while maintaining desired RF performance. The controller 1336 can similarly adjust the second control point(s) of the receive module 1328 to adjust the DC power consumption of the receive module 1328 and/or the electronic RF gain applied to signals received from the sub-bands 1312, 1316, 1320 based on one or more predetermined ratios regarding the total receive gain of each antenna.

In some embodiments, RF linearity of the transmit module 1324 and receive module 1328 can generally increase as the respective first DC bias points and second DC bias points increase. For example, RF linearity of the transmit module 1324 can increase as the transmit module 1324 is programmed to consume greater DC power to generate and output the RF power to the antennas of the ESA 1310; RF linearity of the receive module 1328 can increase as the receive module 1328 is used to apply greater electronic gain to RF signals received from the antennas of the ESA 1310. However, as the DC bias points are increased, more heat can be produced and more DC power is required from the DC power supply 1332. As such, when lower output levels for the transmit module 1324 due to the frequency dependence of the efficiency of the antennas of the ESA 1310 (e.g., the increasing passive antenna gain as a function of frequency), the controller 1336 can generate control signals to digitally reprogram (e.g., reconfigure) the transmit module 1324 to use less DC power due to not needing to produce as much RF power to achieve a same level of effective power (e.g., EIRP). The controller 1336 may also power off the transmit module 1324, such as eliminate heat production in the transmit module 1324. Similarly, if the receive module 1328 receives less input power due to more loss in the antennas of the ESA 1310 at certain frequency ranges, the receive module 1328 can operate with less RF linearity due to the input signals being more attenuated before reaching the receive module 1328 (e.g., the active topologies of the receive module 1328), enabling the controller 1336 to generate control signals to decrease the second DC bias point(s) of the receive module 1328, resulting in less DC power usage by the receive module 1328 and less heat generation. As such, the present solution can reduce overall heat generation, increasing the mean time before failure (MTBF) of the ESA system 1300 (which is negatively affected by heat generation), and also enable wideband performance over wide ranges of the first and second DC bias points, enabling the ESA system 1300 to optimize RF linearity while minimizing DC power consumption and heat generation.

Figure 15:
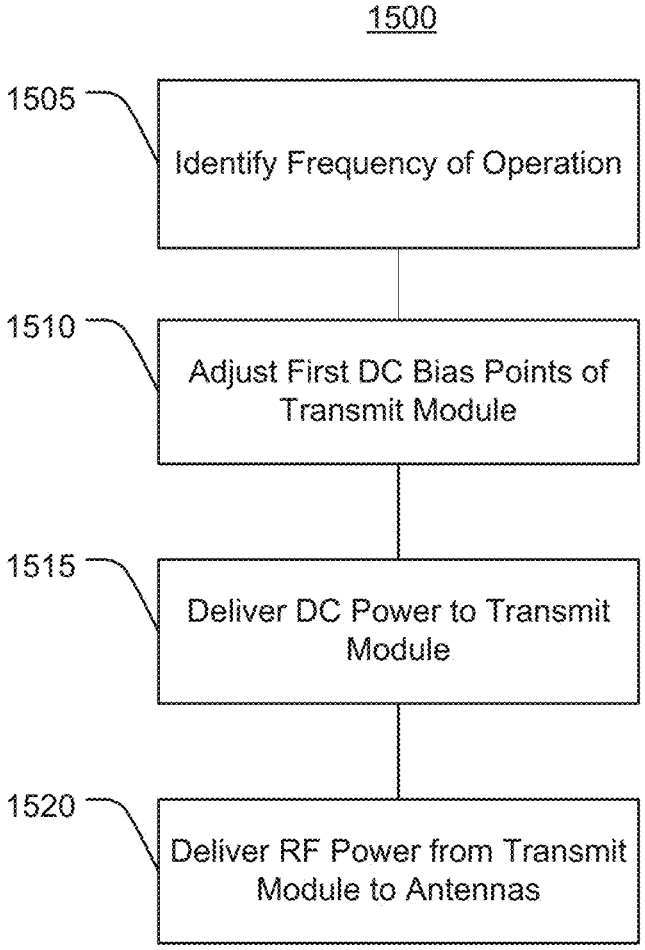
FIG. 15 is a flow diagram of an exemplary embodiment of a method of operating an ESA according to the inventive concepts disclosed herein.

Referring now to FIG. 15, a method 1500 of operating an ESA according to an exemplary embodiment of the inventive concepts disclosed herein may include one or more of the following steps. The method 1500 may be performed using various ESAs and ESA systems described herein, including the ESA system 1300.

A step (1505) may include identifying, by a controller, a frequency of operation of the ESA. The frequency of operation may be a frequency at which the ESA is intended to transmit or receive an RF signal. In some embodiments, it is determined whether the frequency of operation is within a first frequency bandwidth of a plurality of first antennas. The first frequency bandwidth can be from a first frequency to a second frequency greater than the first frequency. In some embodiments, the first frequency is 10 GHz and the second frequency is 60 GHz. The frequency of operation can be within the frequency bandwidth by being greater than or equal to the first frequency and less than or equal to the second frequency.

A step (1510) may include adjusting, by the controller, at least one first control point of a transmit module. The at least one first control point can include DC bias points, one or more gains (e.g., cascaded gains), phase control, time delays, RF linearity control, frequency control, or various combinations thereof that result in a change in how the transmit module generates RF power (and corresponding signal for output) to provide to the antennas of the ESA. The transmit module can be coupled to the plurality of first antennas and the plurality of second antennas, and can receive DC power from a DC power supply and amplify the DC power based on the at least one first DC bias point to generate RF power for providing to the plurality of first antennas and the plurality of second antennas. The at least one first control point can be adjusted to achieve a desired RF signal strengths of an RF signals to be transmitted by the plurality of first antennas and the plurality of second antennas. The at least one first control point can be adjusted based on (1) a predetermined ratio of a first RF signal strength associated with RF transmission by the plurality of first antennas to a second RF signal strength associated with RF transmission by a plurality of second antennas, (2) a first passive antenna gain of the plurality of first antennas, and (3) a second passive antenna gain of the plurality of second antennas. In some embodiments, the first passive antenna gain increases as a function of frequency up to a limit defined by the first frequency. In some embodiments, the predetermined ratio is a one-to-one ratio, such as to enable linear performance of the ESA. In some embodiments, adjusting the at least one first DC bias point includes at least one of adjusting a DC current of the transmit module (e.g., of an RF amplifier of the transmit module) or adjusting a DC voltage of the transmit module. In some embodiments, the first passive antenna gain is greater than the second passive antenna gain. Adjusting the at least one first control point may include independently adjusting first control points corresponding to the plurality of first antennas and the plurality of second antennas, respectively. The at least one first control point may be adjusted to optimize a power at a 1 decibel compression point.

A step (1515) may include delivering DC power from the DC power supply to the transmit module. The transmit module can generate RF power corresponding to the at least one first control point and the received DC power.

A step (1520) may include delivering the RF power corresponding to the adjusted at least one first control point and the received DC power to the plurality of first antennas and the plurality of second antennas. As such, the plurality of first antennas can have an EIRP corresponding to the first passive antenna gain and the amplification provided by the transmit module specifically for the plurality of first antennas, and the plurality of second antennas can have an EIRP corresponding to the second passive antenna gain and the amplification provided by the transmit module specifically for the plurality of second antennas. For example, if it is desired that the EIRP of the plurality of first antennas be equal to the EIRP of the plurality of second antennas, where the first passive antenna gain is greater than the second passive antenna gain, the controller can set a first control point corresponding to the plurality of first antennas to be lower than a first control point corresponding to the plurality of second antennas (e.g., based on a ratio of the first passive antenna gain to the second passive antenna gain).

In some embodiments, the method 1500 includes adjusting at least one second control point of a receive module coupled to the plurality of first antennas and the plurality of second antennas. The receive module can apply an electronic gain to one or more RF signals received from the plurality of first antennas and the plurality of second antennas (e.g., using power from the DC power supply), and the electronic gain can correspond to the at least one second control point. The controller can adjust the at least one second control point based on (1) a second predetermined ratio of a first total receive gain of the plurality of first antennas and the plurality of second antennas, (2) the first passive antenna gain of the plurality of first antennas, and (3) the second passive antenna gain of the plurality of second antennas. As such, the receive module can apply an electronic gain corresponding to the adjusted at least one second DC bias point to the one or more RF signals.

As will be appreciated from the above, systems and methods of ESA RF power allocation according to the inventive concepts disclosed herein can improve operation of ESAs by enabling DC power consumption and heat generation to be reduced, while maintaining desired RF performance capabilities across broad frequency ranges, such as linearity and desired RF signal strength.

It is to be understood that embodiments of the methods according to the inventive concepts disclosed herein may include one or more of the steps described herein. Further, such steps may be carried out in any desired order and two or more of the steps may be carried out simultaneously with one another. Two or more of the steps disclosed herein may be combined in a single step, and in some embodiments, one or more of the steps may be carried out as two or more sub-steps. Further, other steps or sub-steps may be carried in addition to, or as substitutes to one or more of the steps disclosed herein.

From the above description, it is clear that the inventive concepts disclosed herein are well adapted to carry out the objects and to attain the advantages mentioned herein as well as those inherent in the inventive concepts disclosed herein. While presently preferred embodiments of the inventive concepts disclosed herein have been described for purposes of this disclosure, it will be understood that numerous changes may be made which will readily suggest themselves to those skilled in the art and which are accomplished within the broad scope and coverage of the inventive concepts disclosed and claimed herein.

What is claimed is:

1. An electronically scanned antenna array (ESA) system, comprising:

a plurality of first antennas, each having a first RF signal strength and a first passive gain, the plurality of first antennas configured to operate over a first frequency bandwidth from a first frequency to a second frequency greater than the first frequency;

a plurality of second antennas, each having a second RF signal strength different from the first RF signal strength and a second passive gain different from the first passive gain, the plurality of second antennas configured to operate over a second frequency bandwidth from the first frequency to a third frequency greater than the first frequency and less than the second frequency;

a direct current (DC) power supply;

a transmit module having at least one first control point, the transmit module configured to receive DC power from the power supply and provide radio frequency (RF) power corresponding to the DC power and the at least one first control point to the plurality of first antennas and the plurality of second antennas; and a controller coupled to the transmit module, the controller configured to adjust the at least one first control point based on (1) a first predetermined ratio of a first RF signal strength associated with transmission by the plurality of first antennas to a second RF signal strength associated with transmission by the plurality of second antennas, (2) a first passive antenna gain of the plurality of first antennas, and (3) a second passive antenna gain of the plurality of second antennas.

2. The ESA system of claim 1, comprising:

a receive module having at least one second control point, the receive module configured to receive one or more RF signals from the plurality of first antennas and the plurality of second antennas and apply an electronic gain corresponding to the at least one second control point to the received one or more RF signals;

the controller configured to adjust the at least one second control point based on (1) a second predetermined ratio of a first total receive gain of the plurality of first antennas and the plurality of second antennas, (2) the first passive antenna gain of the plurality of first antennas, and (3) the second passive antenna gain of the plurality of second antennas.

3. The ESA system of claim 1, wherein adjusting the at least one first control point of the transmit module reduces heat generation by the transmit module.

4. The ESA system of claim 1, wherein the first predetermined ratio is a one-to-one ratio.

5. The ESA system of claim 1, wherein the at least one first control point includes a DC bias point of the transmit module, and the controller adjusts the at least one first DC bias point by adjusting at least one of a DC current a DC voltage corresponding to the at least one DC bias point.

6. The ESA system of claim 1, wherein the controller adjusts the at least one first control point to optimize a power at the 1 decibel compression point.

7. The ESA system of claim 1, wherein the first passive antenna gain is greater than the second passive antenna gain.

8. The ESA system of claim 1, wherein the first passive antenna gain increases as a function of frequency up to a limit defined by the first frequency.

9. The ESA system of claim 1, wherein the second frequency is at least six times the first frequency.

10. The ESA system of claim 1, wherein each first antenna has a greater size than each second antenna.

11. The ESA system of claim 1, wherein each first antenna is inward of each second antenna.

12. The ESA system of claim 1, wherein the plurality of first antennas and plurality of second antennas form a three-dimensional array.

13. A method of operating an electronically scanned array (ESA), comprising:

identifying, by a controller, a frequency of operation;

adjusting, by a controller coupled to a transmit module having at least one first control point of the transmit module, the at least one control point adjusted based on (1) a first predetermined ratio of a first radio frequency (RF) signal strength associated with transmission by the plurality of first antennas to a second RF signal strength associated with transmission by the plurality of second antennas, (2) a first passive antenna gain of each of the plurality of first antennas, and (3) a second passive antenna gain of each of the plurality of second antennas;

delivering DC power from a DC power supply to the transmit module; and delivering RF power, corresponding to the adjusted at least one first control point and the DC power, from the transmit module to the plurality of first antennas and the plurality of second antennas.

14. The method of claim 13, comprising:

adjusting, by the controller, at least one second control point of a receive module coupled to the controller, based on (1) a second predetermined ratio of a first total receive gain of the plurality of first antennas and the plurality of second antennas, (2) the first passive antenna gain of the plurality of first antennas, and (3) the second passive antenna gain of the plurality of second antennas;

receiving, by the receive module, one or more RF signals from the plurality of first antennas and the plurality of second antennas; and applying, by the receive module, an electronic gain corresponding to the adjusted at least one second control point to the one or more RF signals.

15. The method of claim 13, wherein the first predetermined ratio is a one-to-one ratio.

16. The method of claim 13, wherein the at least one first control point includes a DC bias point of the transmit module, and adjusting the at least one first control point includes at least one of adjusting a DC current or a DC voltage of the at least one first DC bias point.

17. The method of claim 13, comprising adjusting the at least one first control point to optimize a power at the 1 decibel compression point.

18. The method of claim 13, wherein the first passive antenna gain increases as a function of frequency up to a limit defined by the first frequency.

19. The method of claim 13, wherein adjusting the at least one first control point decreases heat generation by the transmit module.

20. The method of claim 13, wherein the plurality of first antennas and plurality of second antennas form a three-dimensional array.

* * * * *